US011217133B2

(12) United States Patent
Bae et al.

(10) Patent No.: US 11,217,133 B2
(45) Date of Patent: Jan. 4, 2022

(54) METHOD FOR CHECKING CRACK IN DISPLAY AND ELECTRONIC DEVICE FOR PERFORMING SAME

(71) Applicant: Samsung Electronics Co., Ltd., Gyeonggi-do (KR)

(72) Inventors: Jongkon Bae, Gyeonggi-do (KR); Hyunjun Park, Gyeonggi-do (KR); Donghwy Kim, Gyeonggi-do (KR); Euntaek Jang, Gyeonggi-do (KR); Dongkyoon Han, Gyeonggi-do (KR); Yunpyo Hong, Gyeonggi-do (KR)

(73) Assignee: Samsung Electronics Co., Ltd.

( * ) Notice: Subject to any disclaimer, the term of this patent is extended or adjusted under 35 U.S.C. 154(b) by 0 days.

(21) Appl. No.: 17/049,091

(22) PCT Filed: May 21, 2019

(86) PCT No.: PCT/KR2019/006100
§ 371 (c)(1),
(2) Date: Oct. 20, 2020

(87) PCT Pub. No.: WO2019/225955
PCT Pub. Date: Nov. 28, 2019

(65) Prior Publication Data

US 2021/0241665 A1 Aug. 5, 2021

(30) Foreign Application Priority Data

May 21, 2018 (KR) ..... 10-2018-0057698

(51) Int. Cl.
*G09G 3/00* (2006.01)
*G09G 3/20* (2006.01)

(52) U.S. Cl.
CPC ..... *G09G 3/006* (2013.01); *G09G 3/20* (2013.01); *G09G 2310/0267* (2013.01);
(Continued)

(58) Field of Classification Search
CPC ..... G09G 3/00; G09G 3/006; G09G 3/20; G09G 3/035; G09G 2310/0267;
(Continued)

(56) References Cited

U.S. PATENT DOCUMENTS 9,767,727 B2 * 9/2017 Byun ..... G09G 3/3208
9,928,768 B2 * 3/2018 Kim ..... G06F 3/0412
(Continued)

FOREIGN PATENT DOCUMENTS

KR 1020080105977 12/2008
KR 1020170002098 1/2017
(Continued)

OTHER PUBLICATIONS

PCT/ISA/210 Search Report issued on PCT/KR2019/006100, dated Sep. 17, 2019, pp. 6.
(Continued)

*Primary Examiner* — Gene W Lee
(74) *Attorney, Agent, or Firm* — The Farrell Law Firm, P.C.

(57) ABSTRACT

An electronic device is provided. The electronic device includes a display panel on which a plurality of pixels are arranged, first group lines providing a source voltage to each of the plurality of pixels, a display driver integrated circuit that includes a plurality of source amplifiers electrically connected with the first group lines and providing the source voltage to each of the plurality of pixels, at least one sensing line crossing the first group lines, and first group switches disposed on the at least one sensing line, and a sensing circuit electrically connected with one end of the at least one sensing line to check a crack in at least a partial region of the electronic device. The display driver integrated circuit receives a specified signal for the electronic device to enter a sense mode, applies a first voltage to the other end of the
(Continued)

at least one sensing line that is distinguished from the one end of the at least one sensing line, in response to the received specified signal, turns on the first group switches such that the at least one sensing line is short-circuited from the other end of the at least one sensing line to the sensing circuit, obtains a second voltage sensed by the sensing circuit electrically connected with the one end of the at least one sensing line, and checks information regarding the crack in the at least partial region of the electronic device based on a difference between the first voltage and the second voltage. In addition to the above, various embodiments identified through the specification are possible.

15 Claims, 12 Drawing Sheets

(52) U.S. Cl.
CPC ..... *G09G 2310/0275* (2013.01); *G09G 2310/0291* (2013.01); *G09G 2310/0297* (2013.01); *G09G 2330/021* (2013.01); *G09G 2330/12* (2013.01)

(58) Field of Classification Search
CPC ... G09G 2310/0275; G09G 2310/0291; G09G 2310/0297; G09G 2330/021; G09G 2330/12
See application file for complete search history.

(56) References Cited

U.S. PATENT DOCUMENTS

| | | | | |
|---|---|---|---|---|
| 10,078,976 | B2 * | 9/2018 | Nam | H01L 22/32 |
| 10,096,667 | B2 * | 10/2018 | Park | H01L 22/34 |
| 10,115,326 | B2 * | 10/2018 | Byun | G09G 3/006 |
| 10,199,005 | B2 | 2/2019 | Kong et al. | |
| 10,210,782 | B2 * | 2/2019 | Lee | G09G 3/006 |
| 10,297,200 | B2 | 5/2019 | Kim et al. | |
| 10,366,644 | B2 * | 7/2019 | Kwon | H01L 27/124 |
| 10,403,196 | B2 | 9/2019 | Shin et al. | |
| 10,573,263 | B2 * | 2/2020 | Fukute | G09G 3/3648 |
| 11,011,085 | B2 * | 5/2021 | Lee | G09G 3/20 |
| 2016/0025791 | A1 * | 1/2016 | Bae | G01R 31/52 324/764.01 |
| 2016/0232826 | A1 * | 8/2016 | Cho | H01L 27/3276 |
| 2018/0053792 | A1 * | 2/2018 | Shin | G09G 3/20 |
| 2020/0066196 | A1 * | 2/2020 | Hao | G01N 27/00 |

FOREIGN PATENT DOCUMENTS

| | | |
|---|---|---|
| KR | 1020170003871 | 1/2017 |
| KR | 1020170064177 | 6/2017 |
| KR | 1020170111788 | 10/2017 |
| KR | 1020180025798 | 3/2018 |

OTHER PUBLICATIONS

PCT/ISA/237 Written Opinion issued on PCT/KR2019/006100, dated Sep. 17, 2019, pp. 5.

* cited by examiner

METHOD FOR CHECKING CRACK IN DISPLAY AND ELECTRONIC DEVICE FOR PERFORMING SAME

PRIORITY

This application is a National Phase Entry of PCT International Application No. PCT/KR2019/006100 which was filed on May 21, 2019, and claims priority to Korean Patent Application No. 10-2018-0057698, which was filed on May 21, 2018, the entire contents of each of which is incorporated herein by reference.

TECHNICAL FIELD

Embodiments disclosed in the present disclosure relate to a method and an electronic device performing the same for checking cracks in a display.

BACKGROUND ART

With the development of information technology (IT), various types of electronic devices including displays, such as a smartphone and a tablet personal computer (PC), have been widely spread.

Since fine elements are elaborately arranged in the display, if the display is shocked in an assembly process of the electronic device, micro cracks may occur in the display. For example, if a crack occurs in a pixel included in the display panel, a specified image may not be output in some region of the display. For another example, if a crack occurs in a source amplifier for transmitting image data to a pixel, the specified image data may not be properly transmitted to the pixel, and an unwanted vertical line may be output on the display.

In order to prevent the above problems in advance, each step of the assembly process of the electronic device may include an operation of checking cracks in the display. For example, if an integrated circuit (IC) of the display is finished, an operation of checking an output voltage or each output terminal, for example, an electrical die sorting (EDS) test may be performed. For another example, when a display module is finished, an operation of checking whether or not an output is abnormal by applying a designated signal to the display module may be performed.

DISCLOSURE OF THE INVENTION

Technical Problem

Even in an operation in which the finished display module is mounted on an electronic device for assembly, cracks may occur inside the display. For example, pressure above a specified level may be generated in some region of the display, or a crack may occur in a part of the display due to other external shocks.

However, when the assembly of the electronic device is completed, it may be difficult to perform an inspection on the interior of the display, for example, a precise inspection such as the EDS test. In this case, the display may be finally checked for defects simply by visual inspection. However, it may be difficult to properly check whether or not the display is defective only by such visual inspection. As described above, the electronic device may be provided to a user without properly checking cracks in the display that may occur in the final assembly step.

Embodiments disclosed in the present disclosure are to provide an electronic device for solving the aforementioned problems and the problems posed in the present disclosure.

Technical Solution

Accordingly, an aspect of the present disclosure is to provide an electronic device including a display panel on which a plurality of pixels are arranged, first group lines providing a source voltage to each of the plurality of pixels, a display driver integrated circuit that includes a plurality of source amplifiers electrically connected with the first group lines and providing the source voltage to each of the plurality of pixels, at least one sensing line crossing the first group lines, and first group switches disposed on the at least one sensing line, and a sensing circuit electrically connected with one end of the at least one sensing line to check a crack in at least a partial region of the electronic device, in which the display driver integrated circuit receives a specified signal for the electronic device to enter a sense mode, applies a first voltage to the other end of the at least one sensing line that is distinguished from the one end of the at least one sensing line, in response to the received specified signal, turns on the first group switches such that the at least one sensing line is short-circuited from the other end of the at least one sensing line to the sensing circuit, obtains a second voltage sensed by the sensing circuit electrically connected with the one end of the at least one sensing line, and checks information regarding the crack in the at least partial region of the electronic device based on a difference between the first voltage and the second voltage.

Another aspect of the present disclosure is to provide a display. The display may include a display panel including a plurality of pixels each including a plurality of sub-pixels, a plurality of source amplifiers electrically connected with the plurality of sub-pixels, first group source switches disposed on an electrical path between output terminals of the plurality of source amplifiers and the plurality of sub-pixels, first group sharing switches selectively connecting the plurality of sub-pixels included in each of the plurality of pixels with each other, first group switches selectively connecting the plurality of pixels with each other, a sensing circuit selectively connected with the plurality of sub pixels or the plurality of source amplifiers through the first group source switches, the first group sharing switches, and the first group switches, and a display driver integrated circuit electrically connected with input terminals of the plurality of source amplifiers and the sensing circuit, in which the display driver integrated circuit may be configured to supply a first voltage to a first source amplifier of the plurality of source amplifiers in a state in which a first source switch corresponding to the first amplifier, at least some of the first group sharing switches, and at least some of the first group switches are turned on, sense a second voltage obtained by transmitting the first voltage to the sensing circuit through the specified first source switch, the at least some of the first group sharing switches, and the at least some of the first group switches by using the sensing circuit, and check information regarding a crack in the display at least based on the sensed second voltage.

Another aspect of the present disclosure is to provide a display. The display may include a display panel that includes a plurality of pixels including a plurality of sub-pixels, one or more source amplifiers electrically connected with the plurality of sub-pixels, a power supply electrically connected with output terminals of the plurality of sub-pixels and the one or more source amplifiers, first group sharing switches selectively connecting the plurality of sub-pixels included in each of the plurality of pixels, first group switches selectively connecting the plurality of pixels with each other, a sensing circuit selectively connected with the plurality of sub-pixels or the one or more source amplifiers through the first group sharing switches and the first group switches, and a display driver integrated circuit electrically connected with input terminals of the one or more source amplifiers and the sensing circuit, in which the display driver integrated circuit may be configured to turn on at least some of the first group sharing switches and at least some of the first group switches, sense a second voltage obtained by transmitting the first voltage supplied from the power supply device to the sensing circuit through the at least some of the first group sharing switches and the at least some of the first group switches, and check information regarding a crack in the display at least based on the sensed second voltage.

Advantageous Effects

According to embodiments disclosed in the present disclosure, an electronic devise may check cracks in a display even in the final assembly step. In this way, a defective rate for an electronic device provided to a user may be reduced. Besides, various effects may be provided that are directly or identified through the present disclosure.

BRIEF DESCRIPTION OF THE DRAWINGS

With respect to the description of the drawings, the same or similar reference signs may be used for the same or similar elements.

MODE FOR CARRYING OUT THE INVENTION

Figure 1:
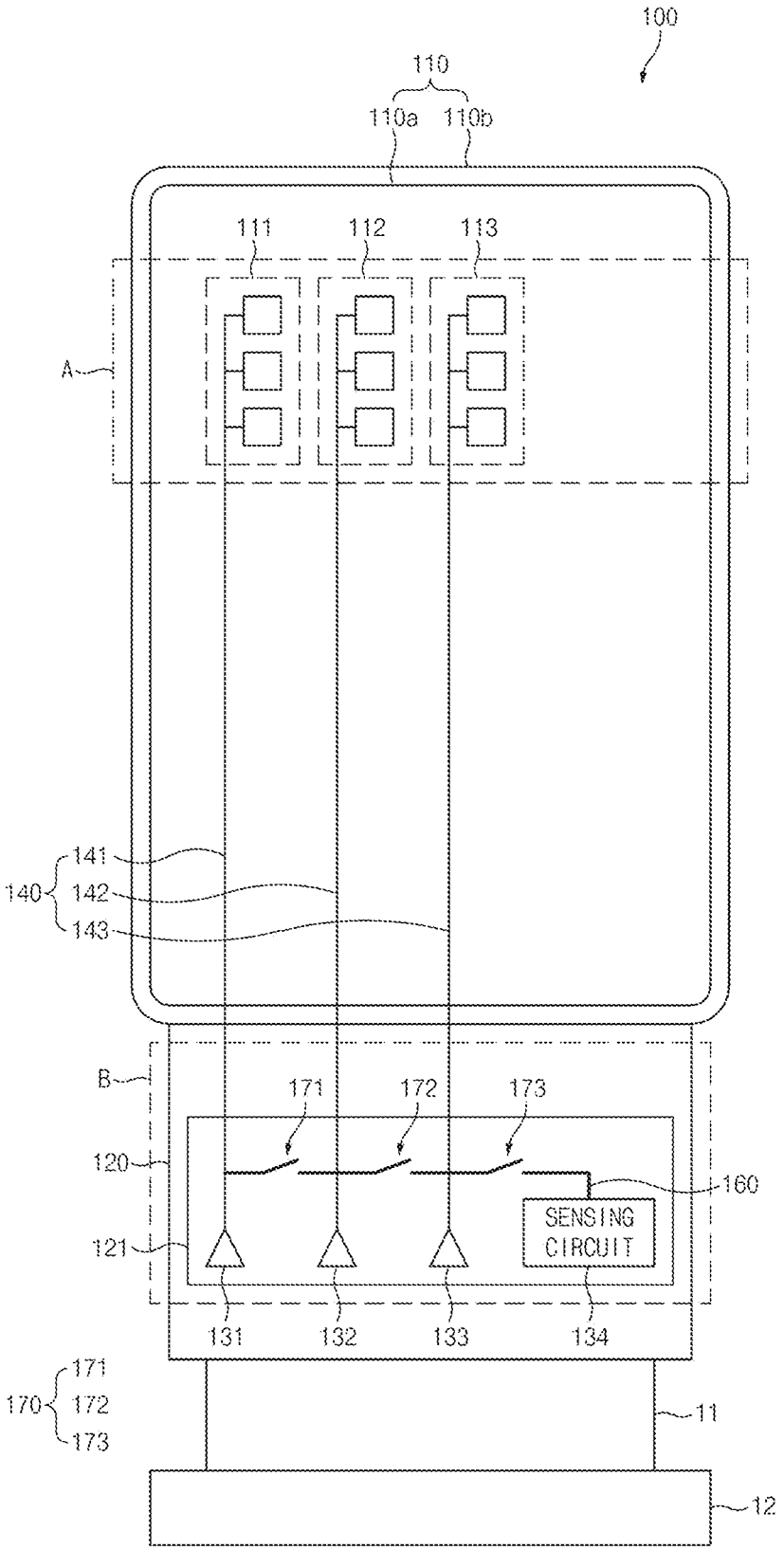
FIG. 1 illustrates an internal diagram of an electronic device according to an embodiment.

FIG. 1 illustrates an internal diagram of an electronic device according to an embodiment.

Referring to FIG. 1, an electronic device 100 may include a display panel 110, a display driver integrated circuit 121, first group lines 140, a flexible printed circuit board (FPCB) 11, and a main printed circuit board (M-PCB) 12. In an embodiment, the electronic device 100 may include a connection member 120, and the display driver integrated circuit 121 and the first group lines 140 may be disposed on the connection member 120. According to various embodiments, the electronic device 100 may further include a component not illustrated in FIG. 1 or may omit a component illustrated in FIG. 1. For example, the electronic device 100 may further include a gate amplifier (not illustrated) for providing a gate voltage to pixels 111, 112, and 113 included in the display panel 110. For another example, the electronic device 100 may omit the FPCB 11.

The display panel 110 may include an active region 110*a* and an inactive region 110*b*. According to an embodiment, the active region 110*a* may include a plurality of pixels 111, 112, and 113 arranged in a grid, and a specified image may be output by using the plurality of pixels 111, 112, and 113. In an embodiment, the inactive region 110*b* may be located at the outer periphery of the active region 110*a*. The inactive region 110*b* may be understood as a region on the display panel 110 in which the pixels 111, 112, and 113 are not arranged.

According to an embodiment, the plurality of pixels 111, 112, and 113 may include a first group pixel 111, a second group pixel 117, and a third group pixel 113, which are divided based on connected source amplifiers 131, 132, and 133. The first group pixel 111 may receive a source voltage from the first source amplifier 131, and the second group pixel 112 may receive a source voltage from the second source amplifier 132. The third group pixel 113 may receive a source voltage from the third source amplifier 133.

The connection member 120 may extend from one end of the display panel 110 to physically connect the display panel 110 with the display driver integrated circuit 121. According to an embodiment, the connection member 120 may include a board, for example, a polyimide (PI) board. According to another embodiment, the connection member 120 may include a board and a bendable film material. Accordingly, at least a portion of the connection member 120 may be bent toward the back surface of the display panel 110.

According to an embodiment, conductive wires for connecting respective components may be disposed on the connection member 120. For example, the first group lines 140 for providing the source voltage to the plurality of pixels 111, 112, and 113 may be disposed on the connection member 120.

The display driver integrated circuit 121 may drive the display panel 110 to output a specified image to the display panel 110 by providing, to the display panel 110, voltages of a specified magnitude, for example, the source voltage or a gate voltage. According to an embodiment, the display driver integrated circuit 121 may include a plurality of source amplifiers 131, 132, and 133, a sensing circuit 134, a sensing line 160, and first group switches 170. According to various embodiments, the display driver integrated circuit 121 may further include a component not illustrated in FIG.

1, for example, a gate amplifier, a gamma circuit, or a controller. According to various embodiments, the display driver integrated circuit 121 may not include the sensing circuit 134, unlike that illustrated in FIG. 1. For example unlike that illustrated in FIG. 1, the sensing circuit 134 may be disposed outside the display driver integrated circuit 121, for example, on the connection member 120, the FPCB 11, or the M-PCB 12.

According to an embodiment, if the electronic device 100 is not in a sense mode, the plurality of source amplifiers 131, 132, and 133 may provide, a specified voltage, for example, the source voltage, to the pixels 111, 112, and 113 through the first group lines 140. For example, the first source amplifier 131 may provide the source voltage to pixels included in the first group pixel 111 through a first line 141, and the second source amplifier 132 may provide the source voltage to pixels included in the second group pixel 112 through a second line 142. The sense mode may be, for example, an operating state of the electronic device 100 for checking whether or not a crack occurs in at least some region of the electronic device 100 after assembly of the electronic device 100.

According to an embodiment, if the electronic device 100 in the sense mode, the plurality of source amplifiers 131, 132, and 133 may provide a specified voltage, for example, a first voltage, to the sensing line 160 through at least one of the first group lines 140. For example, the first source amplifier 131 may provide the first voltage to the sensing line 160 through the first line 141. According to an embodiment, the first voltage may be provided by another component, for example, an external power supply not illustrated in FIG. 1. In this case, the output of the plurality of source amplifiers 131, 132, and 133 may be limited. For example, the plurality of source amplifiers 131, 132, and 133 may not provide the first voltage to the first group lines 140.

In the present specification, the first voltage may be understood as a voltage applied to the other end of the sensing line 160 that is distinguished from one end of the sensing line 160 connected with the sensing circuit 134. The second voltage distinguished from the first voltage may be understood as a voltage sensed by the sensing circuit 134 by transmitting the first voltage from the other end of the sensing line 160 to the one end thereof through the sensing line 160.

According to an embodiment, the sensing circuit 134 may be connected with one end of the sensing line 160 to check a crack in at least some region of the electronic device 100. The sensing circuit 134 may compare the signal applied to the other end of the sensing line 160, for example, the first voltage with the signal obtained by the sensing circuit 134, for example, the second voltage to check the crack in at least some region of the electronic device 100. For example, the sensing circuit 134 may check whether or not the region on which the sensing line 160 is disposed is cracked. For another example, the sensing circuit 134 may check whether or not the source amplifiers 131, 132, and 133 connected with the sensing line 160 are cracked. For yet another example, the sensing circuit 134 may check whether or not the plurality of pixels 111, 112, and 113 connected with the sensing line 160 are cracked. In the present specification, the sensing circuit 134 may also be referred to as a voltage sensing block.

According to an embodiment, the sensing line 160 may be at least one conductive line crossing the first group lines 140. According to an embodiment, one end of the sensing line 160 may be electrically connected with the sensing circuit 134. A specified signal, for example, the first voltage, may be applied to the other end of the sensing line 160 that is distinguished from one end thereof. The sensing line 160 may transmit the first voltage applied from the other end to the sensing circuit 134 connected to the one end. The voltage obtained by the sensing circuit 134 by transmitting the first voltage may be referred to as a second voltage that is distinguished from the first voltage.

According to an embodiment, the other end of the sensing line 160 may be electrically connected with the output terminal of at least one of the source amplifier 131, 132, or 133 as illustrated in FIG. 1. According to another embodiment, the other end of the sensing line 160 may be electrically connected with a specified external power supply not illustrated in FIG. 1 or an output terminal of a separate source amplifier.

According to an embodiment, the first group switches 170 may be disposed on the sensing line 160. According to an embodiment, the first group switches 170 may be disposed between the first group lines 140 electrically connected with each pixel, or may be disposed between at least one of the first group lines 140 and the sensing circuit 134. According to an embodiment, the first group switches 170 may be turned on or off based on the control of the sensing circuit 134.

According to an embodiment, if the electronic device 100 is in the sense mode, at least some of the first group switches 170 may be turned on, and at least a part of the sensing line 160 may be short-circuited. If the electronic device 100 is not in the sense mode, all of the first group switches 170 may be turned off and the sensing line 160 may be opened.

According to an embodiment, the first group lines 140 may be a set of conductive lines extending from each of the source amplifiers 131, 132, and 133 to the plurality of pixels 111, 112, and 113. In an embodiment, the first group lines 140 may be disposed on the connection member 120. According to various embodiments, the first group lines 140 may electrically connect the plurality of pixels 111, 112, and 113 with the source ampifiers 131, 132, and 133. In this way, specified electrical signals, for example, a voltage or a current may be transmitted to each other.

According, to an embodiment, the FPCB 11 may be connected with the connection member 120 and the M-PCB 12. The FPCB 11 may be implemented with a bendable material, for example, a film. In an embodiment, when the FPCB 11 is bent toward the back surface of the connection member 120 or the display panel 110, the M-PCB 12 may be disposed on the back surface side of the connection member 120 or the display panel 110.

In an embodiment, at least one electronic component or conductive wires electrically connecting the at least one electronic component with each other may be disposed on the FPCB 11. For example, unlike that illustrated in FIG. 1, on the FPCB 11, the sensing circuit 134 may be disposed and conductive wires electrically connected with the sensing circuit 134, for example, at least some of the sensing line 160 may be disposed.

According to an embodiment, the M-PCB 12 may be connected with the connection member 120 through the FPCB 11. In another embodiment, the M-PCB 12 may be directly connected with the connection member 120, unlike that illustrated in FIG. 1. According to an embodiment, on the M-PCB 12, there may be arranged various electronic components included in the electronic device 100 and conductive wires electrically connecting the electronic components. Examples of the electronic components may include a processor, a memory, an external power supply, or the sensing circuit 134 (unlike that illustrated in FIG. 1).

In the present disclosure, components having the same reference numerals as those included in the electronic device 100 illustrated in FIG. 1 may be the same as those described in FIG. 1.

Figure 2:
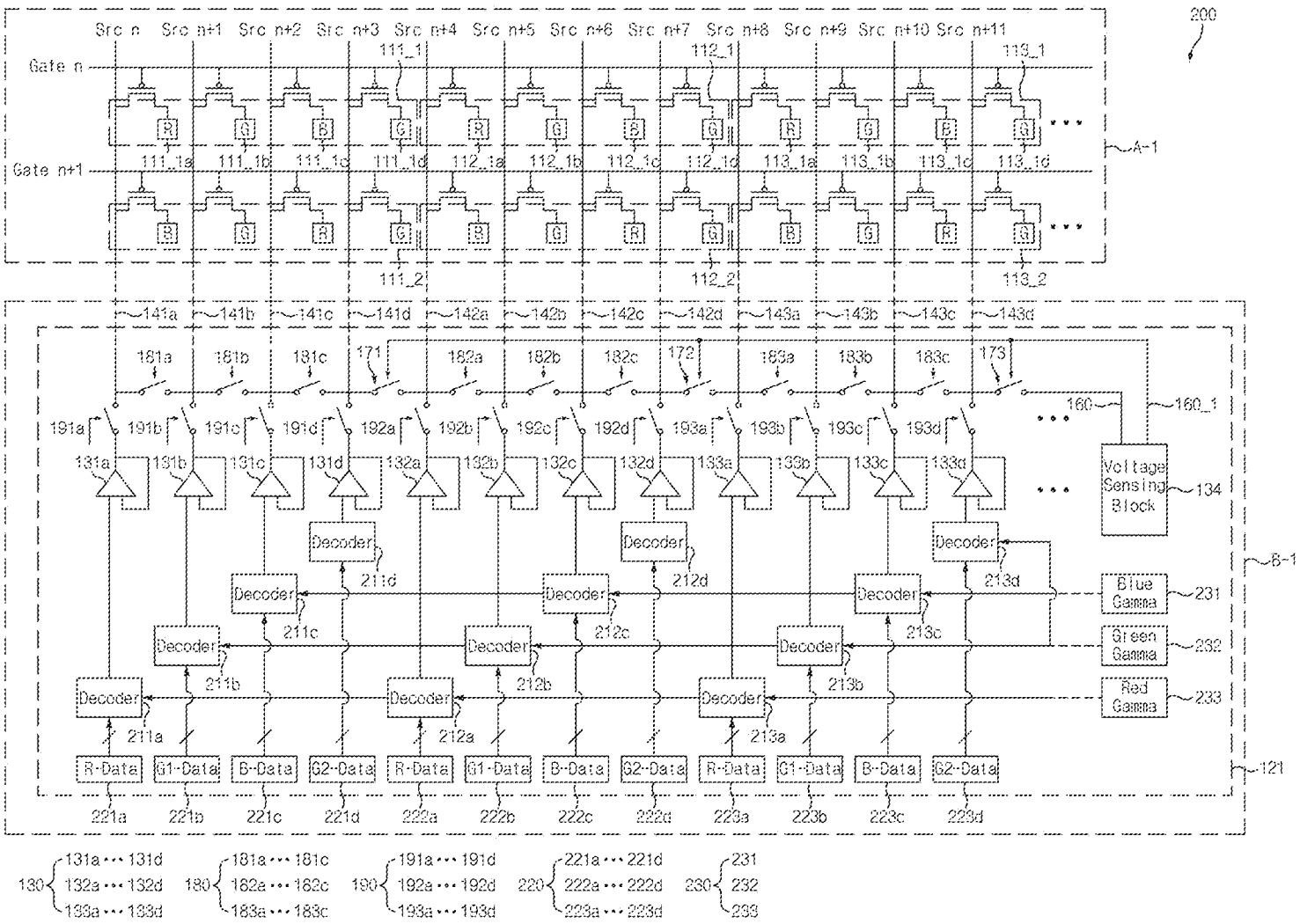
FIG. 2 illustrates a detailed circuit diagram an electronic device for checking cracks in a connection member and a source amplifier, according to an embodiment.

FIG. 2 illustrates a detailed circuit diagram of an electronic device for checking cracks in a connection member and a source amplifier, according to an embodiment.

Referring to FIG. 2, an electronic device 200 may include a region A-1 and a region B-1. The region A-1 may be understood as an enlarged view of the region A illustrated in FIG. 1, and the region B-1 may be understood as an enlarged view of the region B illustrated in FIG. 1. In other words, the region A-1 may represent a port a region of the display panel 110, and the region B-1 may represent a portion of the connection member 120 on which the display driver integrated circuit 121 disposed. In the description of FIG. 2, content that has been already shown in the description of FIG. 1 may be omitted.

Referring to the A-1 region, the display panel 110 may include a plurality of pixels 111_1, 111_2, 112_1, 112_2, 113_1, and 113_2. According to an embodiment, each of the plurality of pixels 111_1, 111_2, 112_1, 112_2, 113_1, and 113_2 may include a plurality of sub-pixels. For example, each of the pixels, for example, the first pixel 111 may include one red sub-pixel 111_1*a*, two green sub-pixels 111_1*b* and 111_1*d*, and one blue sub-pixel 111_1*c*, as illustrated in FIG. 2. For another example, each of the pixels may include one red sub-pixel, one green sub-pixel, and one blue sub-pixel, unlike illustrated in FIG. 2. For yet another example, each of the pixels may include one red sub-pixel, one green sub-pixel, one blue sub-pixel, and one white blue sub-pixel unlike that illustrated in FIG. 2.

According to an embodiment, each of the sub-pixels (e.g., the first red sub-pixel 111_1*a*) may be electrically connected with the first group lines 140. The first group lines 140 may include a plurality of lines 141*a*, 141*b*, 141*c*, 141*d*, 142*a*, 142*b*, 142*c*, 142*d*, 143*a*, 143*b*, and 143*d*. The sub-pixels may receive a source voltage from the source amplifiers 130 through the first group lines.

Referring to the B-1 region, the first group lines 140 and the display driver integrated circuit 121 may be disposed on the connection member 120. In an embodiment, the display driver integrated circuit 121 may include the plurality of source amplifiers 130, first group source switches 190, a decoder group 210, a gamma circuit 230, and the sensing circuit 134. The sensing line 160, first group sharing switches 180, the first group switches 170, and a control line 160_1 may be disposed in the display driver integrated circuit 121.

According to various embodiments, the connection member 120 or the display driver integrated circuit 121 is not limited to that illustrated in FIG. 2. For example, the display driver integrated circuit 121 may further include a gate amplifier, and the connection member 120 may further include second group lines connected with the gate amplifier. For another example, the display driver integrated circuit 121 may further include a controller that controls the configuration of the display driver integrated circuit 121. For yet another example, the sensing circuit 134 may not be included in the display driver integrated circuit 121 and may be disposed on the FPCB 11 or the M-PCB 12 illustrated in FIG.

According to an embodiment, the first group sharing switches 180 and the first group switches 170 may be disposed between the first group lines 140. According to an embodiment, the first group switches 170 may be disposed between any one of the first group lines 140 and the sensing circuit 134.

In an embodiment, the first group sharing switches 180 may be disposed between lines for sub-pixels included in one pixel of the first group lines 140. For example, the first group sharing switches 180 may be disposed among the first line 141*a*, the second line 141*b*, the third line 141*c*, and the fourth line 141*d* for the sub-pixels 111_1*a*, 111_1*b*, 111_1*c*, and 111_1*d* included in the first pixel 111_1. In an embodiment, sub-pixels included in one pixel may be selectively connected through the first group sharing switches 180. For example, the first red sub-pixel 111_1*a* and the first green sub-pixel 111_1*b* may be selectively connected through a first sharing switch 181*a* along the first line 141*a* and the second line 141*b*.

In an embodiment, the first group switches 170 may be disposed between lines positioned at a boundary between different pixels. For example, the first group switches 170 may be disposed between the fourth line 141*d* and the fifth line 142*a* positioned between the first pixel 111_1 and the second pixel 112-1.

According to an embodiment, if the electronic device 200 is not in the sense mode, the first group sharing switches 180 may share some of the outputs of the source amplifiers 130 among a plurality of sub-pixels included in one pixel. For example, the first sharing switch 181*a* may be turned on to share the output of a first red source amplifier 131*a* between the first red sub-pixel 111_1*a* and the first green sub-pixel 111_1*b*. For another example, the first sharing switch 181*a* and a second sharing switch 181*b* may be turned on to share the output of the first red source amplifier 131*a* among the first red sub-pixel 111_1*a*, the first green sub-pixel 111_1*b*, and the first blue sub-pixel 111_1*c*. In this case, since the electronic device 200 may inactivate at least some of the source amplifiers 130, power consumption may be reduced.

According to an embodiment, if the electronic device 200 is in the sense mode, the first group sharing switches 180 and the first group switches 170 may short-circuit at least a part of the sensing line 160. For example, if the electronic device 200 is in the sense mode, the first group sharing, switches 180 and the first group switches 170 may be all turned on. In this case, the sensing line 160 may be short-circuited from the first line 141*a* to the sensing circuit 134, and a specified signal, for example, the first voltage, applied from the other end of the sensing line 160, for example, the first line 141*a*, may be transmitted to one end of the sensing line 160, for example, the sensing circuit 134.

According to an embodiment, the control line 160_1 may be a signal line for controlling the first group switches 170. In an embodiment, the sensing circuit 134 may turn on or off the first group switches 170 through the control line 160_1. For example, if the electronic device 200 is in the sense mode, the sensing circuit 134 may turn on at least some of the first group switches 170 through the control line 160_1. For another example, when the electronic device 200 is not in the sense mode, the sensing, circuit 134 may turn off the first group switches 170 through the control line 160_1. If the first group switches 170 are turned off, at least a part of the sensing line 160 may be opened, and the output of the source amplifier may not be shared between different pixels.

According, to an embodiment, the plurality of source amplifiers 130 may amplify an electrical signal, for example, a voltage input from the decoder group 210 by a specified level and output the amplified voltage. According to an embodiment, when the electronic device 200 is not in the sense mode, the source amplifiers 130 may provide the output voltage to a plurality of pixels or sub-pixels. According to an embodiment, if the electronic device 200 is in the sense mode, the source amplifiers 130 may apply the output voltage to the sensing line 160.

According to an embodiment, first group source switches 190 may be disposed at the respective output terminals of the source amplifiers 130. The first group source switches 190 may activate or inactivate the output of each of the source amplifiers 130. For example, if the electronic device 200 is in the sense mode, a first source switch 191*a* among the first group source switches 190 may be turned on and the remaining source switches may be turned off. In this case, the output of the first source amplifier 131*a*, for example, the first voltage may be applied to the sensing line 160. The first voltage may be transmitted to the sensing circuit 134 through the sensing line 160. For another example, if the electronic device 200 is in the sense mode, the first group source switches 190 may be sequentially turned on or off one by one according to a specified time interval. In this case, the outputs of the plurality of source amplifiers 130 may be sequentially applied to the sensing line 160 one by one according to a specified time interval.

According to an embodiment, the decoder group 210 may combine image data 220 and grayscale voltage data received from the gamma circuit 230. The image data 220 may be provided, for example, from a controller. According to an embodiment, the combined data may be converted from a digital signal to an analog signal, for example, a voltage. The decoder group 210 may provide the converted analog signal to the source amplifiers 130.

According to an embodiment, the gamma circuit 230 may include a red gamma circuit 233, a green gamma circuit 232, and a blue gamma circuit 231, which are classified according to characteristics of sub-pixels. The gamma circuit 230 may generate grayscale voltage data for determining the grayscale of each sub-pixel. The generated grayscale voltage data may be converted into an analog signal, for example, a grayscale voltage, and combined with the image data 220.

According to an embodiment, the electronic device 200 may enter the sense mode based on a specified signal. The specified signal may be, for example, a specified input from a user or a signal applied from an external device. In an embodiment, the specified signal may be transmitted to the display driver integrated circuit 121.

According to an embodiment, the display driver integrated circuit 121 may enter the sense mode upon receiving the specified signal. The display driver integrated circuit 121 may apply the first voltage to the other end of the sensing line 160, for example, the opposite end of the one end connected with the sensing circuit 134 in response to the received specified signal.

According to various embodiments, the first voltage may be applied by various configurations. For example, the first voltage may be applied by any one of the plurality of source amplifiers 130. For example, the display driver integrated circuit 121 may turn on the first source switch 191*a* and apply a specified value to first image data 221*a*. In this case, the first voltage may be applied by the first source amplifier 131*a*.

According to an embodiment, when entering the sense mode, the display driver integrated circuit 121 may turn on the first group switches 170 such that the sensing line 160 is short circuited from the other end of the sensing line 160 to the sensing circuit 134. The display driver integrated circuit 121 may turn on the first sharing switch 181*a* such that the sensing line 160 is short-circuited. In an embodiment, if the sensing line 160 is short-circuited, the first voltage applied to the other end of the sensing line 160 may be transmitted to the sensing circuit 134 through the sensing line 160.

According to an embodiment, the display driver integrated circuit 121 may obtain a second voltage sensed by the sensing circuit 134. According to an embodiment, the display driver integrated circuit 121 may check information regarding a crack in a region including the sensing line 160 based on a difference between the first voltage and the second voltage. The information regarding the crack may include, for example, whether a crack is present, the degree of the crack, or the location of the crack. In an embodiment, if no crack exists in the region including the sensing line 160, the difference between the second voltage and the first voltage may be less than or equal to a specified level. In another embodiment, if a crack exists in the region including the sensing line 160, the difference between the second voltage and the first voltage may exceed the specified level. According to an embodiment, the magnitude of the first voltage or the specified level may be a value previously stored in a memory or the like.

According to an embodiment, the display driver integrated circuit 121 may check whether or not the source amplifier 130 is abnormal, as well as whether or not the region including the sensing line 160 is cracked, by using the sensing circuit 134. For example, the display driver integrated circuit 121 may check whether or not the source amplifier 130 is abnormal by changing the source amplifier 130 applying the first voltage. In an embodiment, the display driver integrated circuit 121 may control the source amplifiers 130 such that each of the source amplifiers 130 sequentially applies the first voltage to the other end of the sensing line 160 according to a specified time interval example, the display driver integrated circuit 121 may control the first group source switches 190 disposed at the output terminals of the plurality of source amplifiers 130 to be turned on one by one according to the specified time interval. In an embodiment, the display driver integrated circuit 121 may obtain the second voltage corresponding to each first voltage at the specified time interval. The display driver integrated circuit 121 may check whether or not each of the plurality of source amplifiers 130 is abnormal based on the difference between the first voltage and the second voltage at the specified time interval.

In the present disclosure, components having the same reference numerals as those included in the electronic device 200 illustrated in FIG. 2 may be the same as those described in FIG. 2.

Figure 3:
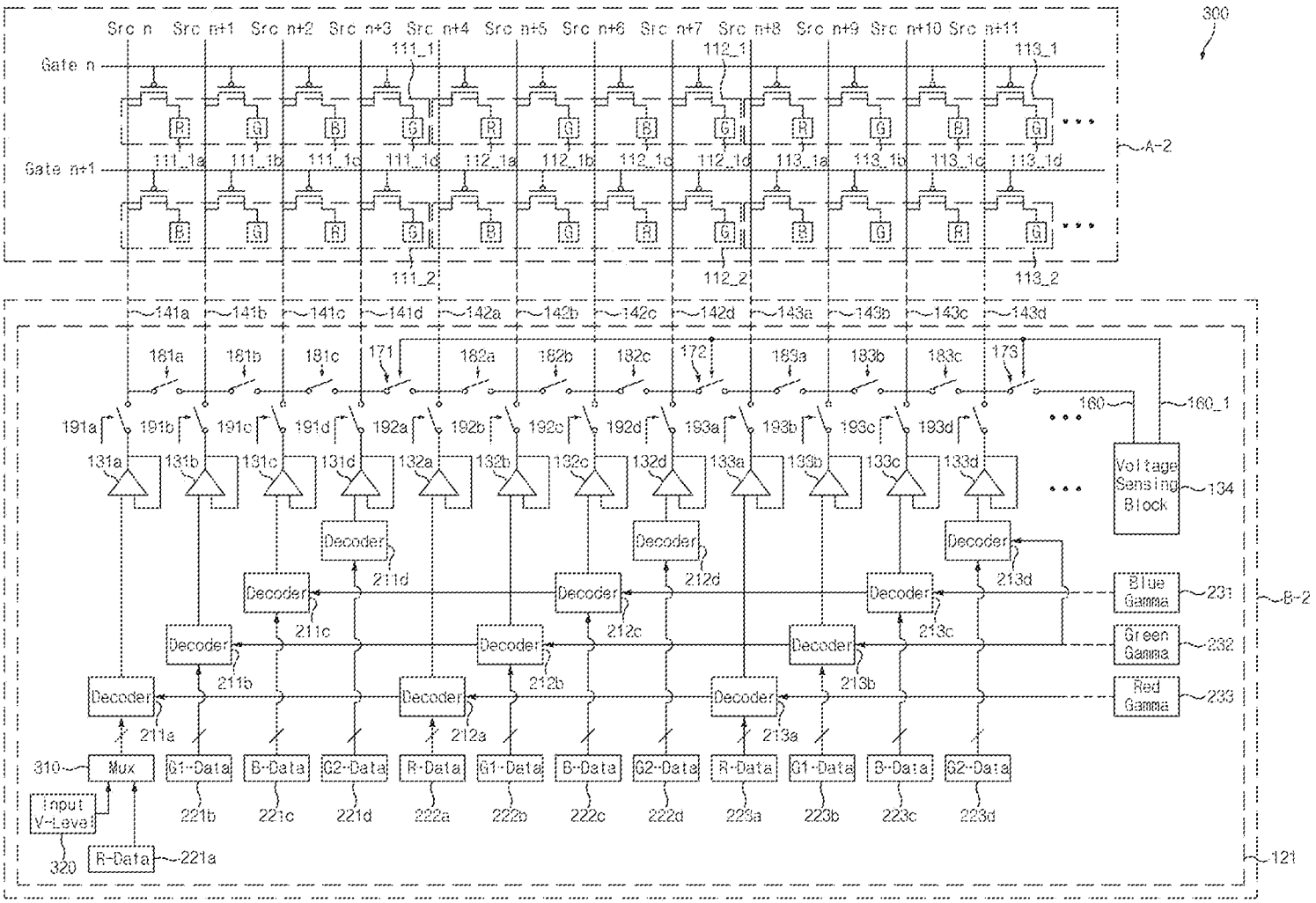
FIG. 3 illustrates a detailed circuit diagram of an electronic device for checking cracks in a connection member and a source amplifier, according to another embodiment.

FIG. 3 illustrates a detailed circuit diagram of an electronic device 300 for checking cracks in a connection member 120 and a source amplifier, according to another embodiment.

Referring to FIG. 3, the electronic device 300 may include a region A-2 and a region B-2. The region A-2 may be understood as an enlarged view of the region A illustrated in FIG. 1, and the region B-2 may be understood as an enlarged view of the region B illustrated in FIG. 1. In other words, the region A-2 may represent a portion of the region of the display panel 110, and the region B-2 may represent a portion of the connection member 120 on which the display driver integrated circuit 121 is disposed. In the description of FIG. 3, content that has been already shown in the description of FIG. 2 may be omitted.

Referring to B-2 region, the display driver integrated circuit 121 may include any one of the plurality of source amplifiers 130, for example, a multiplexer 310 electrically connected with the first source amplifier 131*a*. In an embodiment, the first source amplifier 131*a* and the multiplexer 310 may be electrically connected through a first decoder 211*a*.

According to an embodiment, the multiplexer 310 may receive the first image data 221*a* and sensing power data 320 as inputs, and may select an output based on the operating state of the electronic device 300. For example, if the electronic device 300 is in the sense mode, the multiplexer 310 may select the sensing power data 320 as an output and may transmit the sensing power data 320 to the first decoder 211*a*. For another example, if the electronic device 300 is not in the sense mode, the multiplexer 310 may select the first image data 221*a* as an input and may transmit the first image data 221*a* to the first decoder 211*a*. In an embodiment, the operation of the multiplexer 310 may be controlled by a controller (not illustrated) included in the display driver integrated circuit 121.

According to an embodiment, the sensing power data 320 may be changed based on a user input. For example, if the electronic device 300 is in the sense mode, the display driver integrated circuit 121 may change the value of the sensing power data 320 based on the user input. In this way, the display driver integrated circuit 121 may adjust the output of the first source amplifier 131*a*.

According to an embodiment, the electronic device 300 is in the sense mode, the display driver integrated circuit 121 may turn on the first source switch 191*a* and may apply the output of the first source amplifier 131*a* to the sensing line 160 as the first voltage. The display driver integrated circuit 121 may change the value of the sensing power data 320 and may adjust the magnitude of the first voltage applied to the sensing line 160 by us ng the multiplexer 310.

In the present disclosure, components having the same reference numerals as those included in the electronic device 300 illustrated in FIG. 3 may be the same as those described in FIG. 3.

Figure 4A:
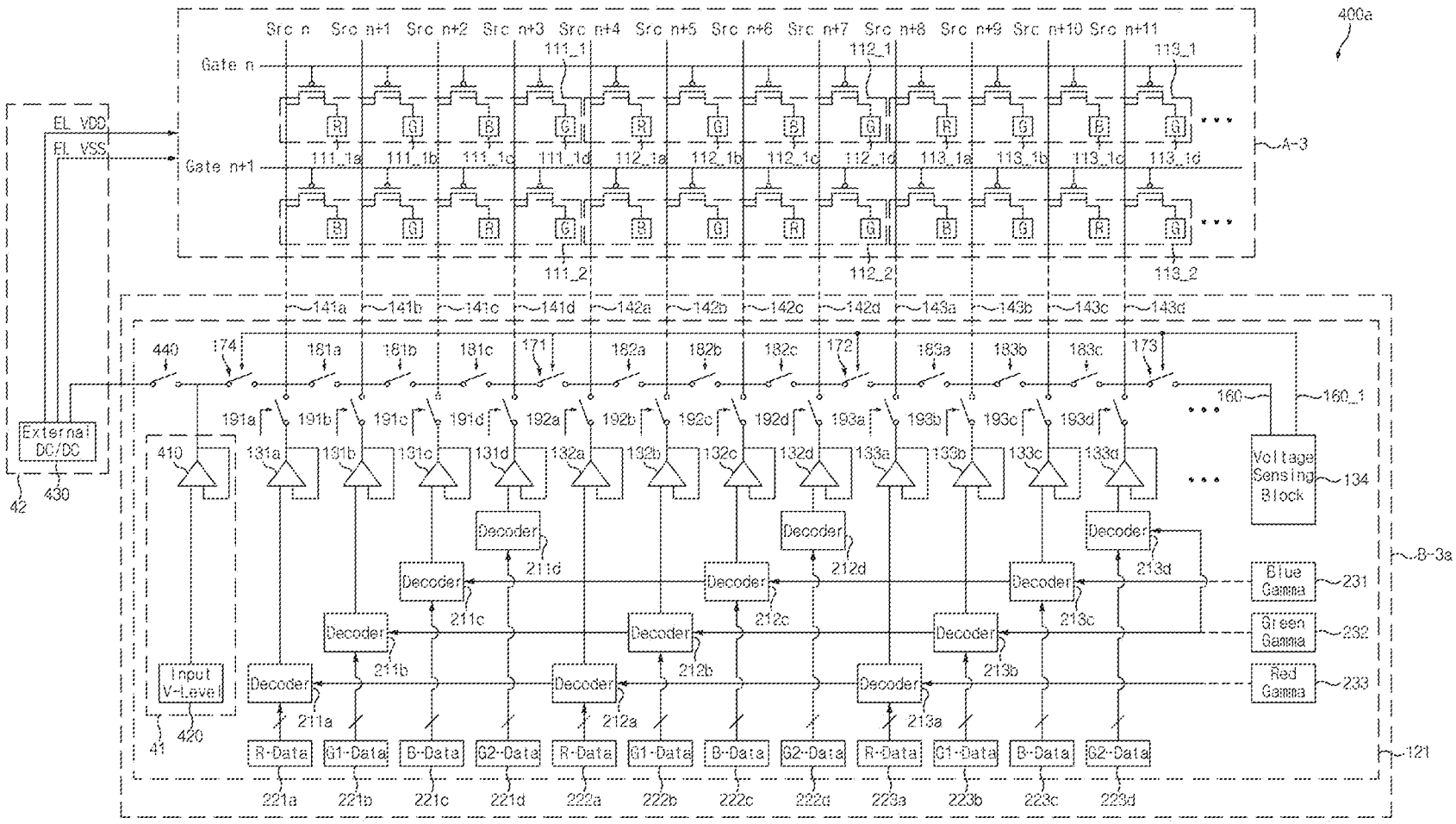
FIG. 4*a* illustrates a detailed circuit diagram of an electronic device for checking cracks in a connection member and a source amplifier, according to yet another embodiment.
Figure 4B:
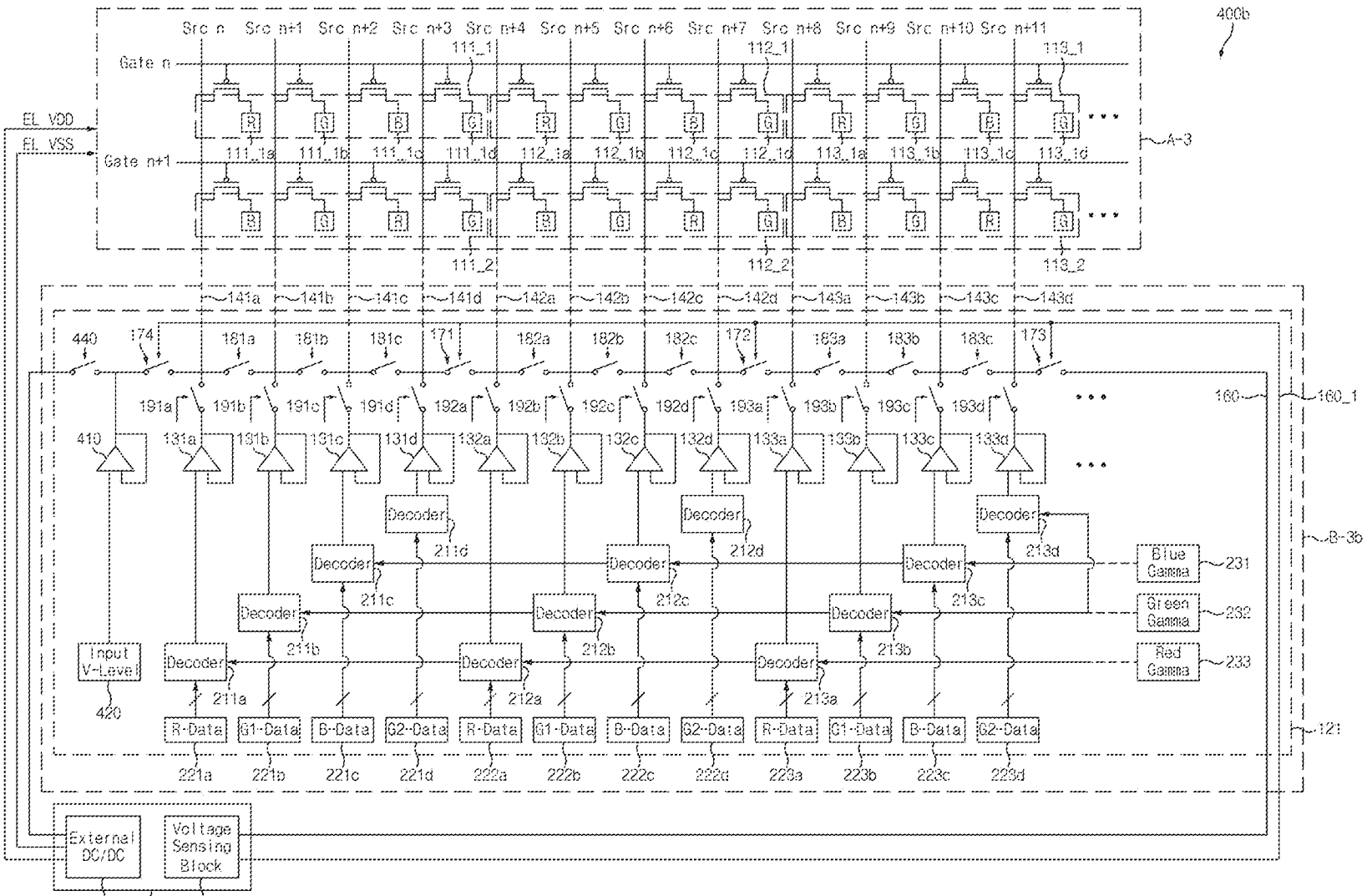
FIG. 4*b* illustrates a detailed circuit diagram of an electronic device for checking cracks in a connection member and a source amplifier, according to yet another embodiment.

FIG. 4*a* and FIG. 4*b* illustrate detailed circuit diagrams of electronic devices for checking cracks in connection members and source amplifiers, according to yet another embodiment.

Referring to FIG. 4*a*, an electronic device 400*a* may include a region A-3 and a region B-3*a*. The region A-3 may be understood as an enlarged view of the region A illustrated in FIG. and the region B-3*a* may be understood as enlarged view of the region B illustrated in FIG. 1. In other words, the region A-3 may represent a portion of the region of the display panel 110, and the region B-3*a* may represent a portion of the connection member 120 on which the display driver integrated circuit 121 disposed. In the description of FIG. 4*a*, content that has been already shown in the description of FIG. 2 may be omitted.

According to an embodiment, the electronic device 400*a* may include at least one of a first module and a second module 42 to apply the first voltage to the sensing line 160. According to various embodiments, at least one of the first module 41 and the second module 42 illustrated in FIG. 4*a* may be omitted.

According to an embodiment, the first module 41 may include a sense amplifier 410. The sense amplifier 410 may be a separate amplifier distinguished from the source amplifier 130 and may be electrically connected with the other end of the sensing line 160. The sense amplifier 410 may apply the first voltage to the sensing line 160 such that cracks in the connection member 120 are checked. In this case, all of the first group source switches 190 disposed at the output terminals of the source amplifiers 130 may be turned off.

According to an embodiment, sensing power data 420 may be input to the sense amplifier 410. In an embodiment, the sensing power data 420 may be changed based on a user input. For example, if the electronic device 400*a* is in the sense mode, the display driver integrated circuit 121 may change the value of the sensing power data 420 based on the user input. In this way, the display driver integrated circuit 121 may adjust the output of the sense amplifier 410 and the magnitude of the first power supply.

According to an embodiment, the second module may include an external power supply 430 and a power switch 440. The external power supply 430 may be, for example, a power management module (e.g., a power management module 888 of FIG. 8) for supplying power to the display driver integrated circuit 121. For another example, the external power supply 430 may be a power regulator disposed inside the display driver integrated circuit 121 and supplying power to the display panel 110. In an embodiment, the power switch 440 may be disposed between the external power supply 430 and the sensing line 160.

According D an embodiment, the external power supply 430 may include terminals for connection to at least a portion of the display driver integrated circuit 121, for example, general purpose input output (GPIO) terminals. The external power supply 430 may provide the first voltage to at least a portion of the display driver integrated circuit 121, for example, to the other end of the sensing line, through the terminals. According to various embodiments, the external power supply 430 may be disposed on the FPCB 11 or the M-PCB 12 illustrated in FIG. 1.

According to an embodiment, if the electronic device 400*a* in the sense mode, the display driver integrated circuit 121 may turn on the power switch 440. The external power supply 430 may apply the first voltage to the sensing line 160 through the power switch 440.

As described above, the electronic device 400*a* may apply the first voltage to the sensing line 160 through the first module or the second module 42, and the display driver integrated circuit 121 may check whether not the region including the sensing line 160 is cracked through the first voltage and the second voltage obtained through the sensing circuit 134.

Referring to FIG. 4*b*, an electronic device may include a region A-3 and a region B-3*b*. The region B-3*b* may be understood as an enlarged view of the region B illustrated in FIG. 1. In other words, the region B-3*b* may represent a portion of the connection member 120 in which the display driver integrated circuit 121 is disposed. In the description of FIG. 4*b*, content that has been already shown in the description of FIG. 2 or the description of FIG. 4*a* may be omitted.

According to an embodiment, an electronic device 400*b* may omit the first module 41 and the second module 42 and include a sensing module 460, unlike the electronic device 400*a* illustrated in FIG. 4*a*. The sensing module 460 may be understood as an integrated circuit (IC) including the external power supply 430 and the sensing circuit 134. According to an embodiment, the sensing module 460 may be disposed outside the display driver integrated circuit 121, for example, on the FPCB 11 or the M-PCB 12 illustrated in FIG. 1.

According to an embodiment, the sensing module 460 may transmit the specified power to the display driver integrated circuit 121 by using the external power supply 430. For example, the sensing module 460 may apply the first voltage to the sensing line 160 by using the external power supply 430. The external power supply 430 may be, for example, a power management module (e.g., the power management module 888 of FIG. 8) for supplying power to the display driver integrated circuit 121.

According to an embodiment, the sensing module 460 may check whether or not the region including the sensing line 160 is cracked by using the sensing circuit 134. For example, the sensing module 460 may obtain the magnitude of the second voltage measured at one end of the sensing line 160 by using the sensing circuit 134. The sensing module 460 may check whether or not the region including the sensing line 160 is cracked through the first voltage and the second voltage.

In the present disclosure, components having the same reference numerals as those included in the electronic device 400*a* illustrated in FIG. 4*a* or the electronic device 400*b* illustrated in FIG. 4*b* are the same as those described in FIG. 4*a* or FIG. 4*b*.

Figure 5:
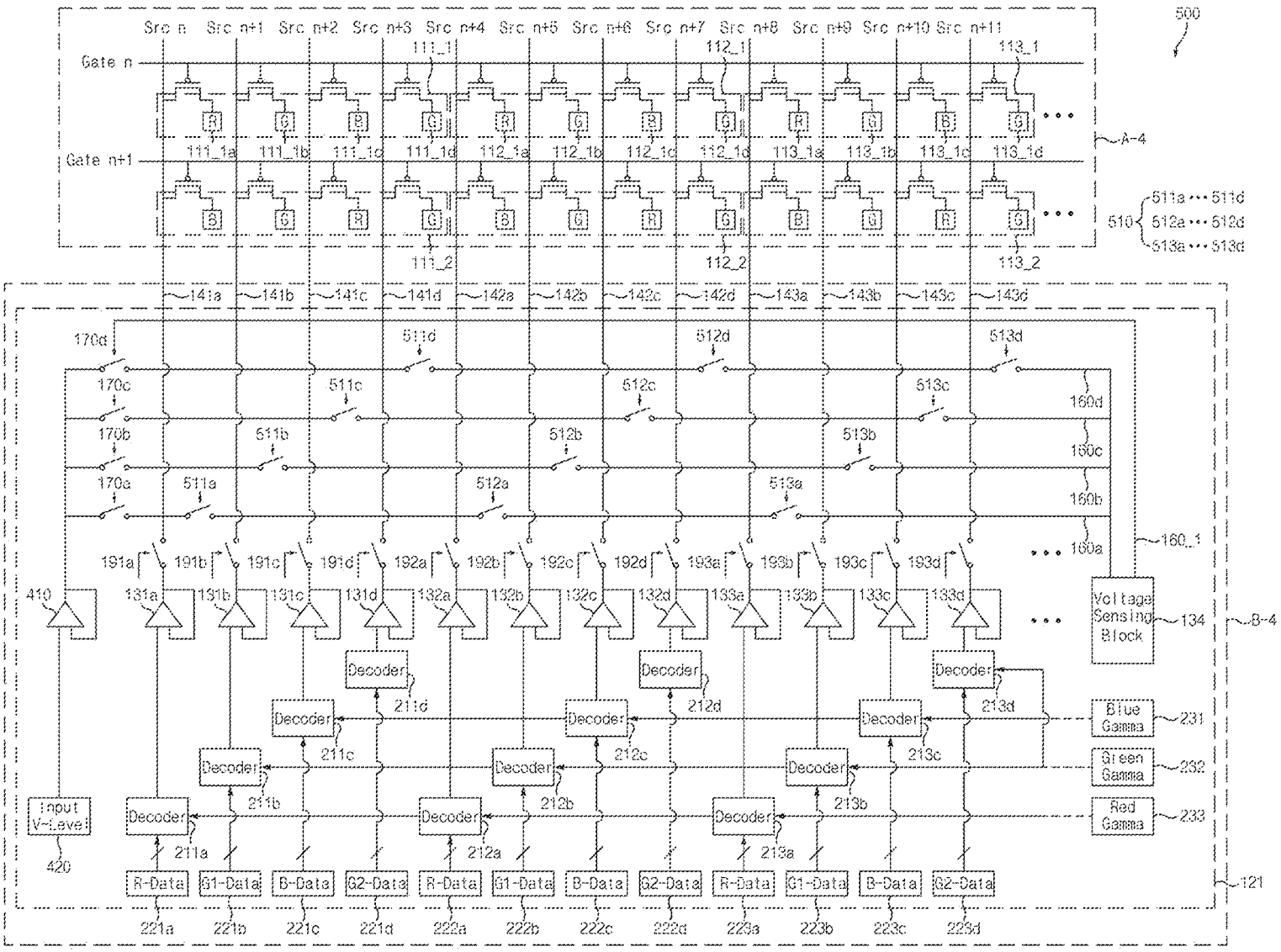
FIG. 5 illustrates a detailed circuit diagram of an electronic device including a plurality of sensing lines, according to an embodiment.

FIG. 5 illustrates a detailed circuit diagram of an electronic device including a plurality of sensing lines, according to an embodiment.

Referring to FIG. 5, an electronic device may include a region A-4 and a region B-4. The region A-4 may be understood as an enlarged view of the region A illustrated in FIG. 1, and the region B-4 may be understood as an enlarged view of the region B illustrated in FIG. 1. In other words, the region A-4 may represent a portion of the region of the display panel 110, and the region B-4 may represent a portion of the connection member 120 on which the display driver integrated circuit 121 is disposed. In the description of FIG. 5, content that has been already shown in the description of FIG. 2 may be omitted.

Referring to B-4, the display driver integrated circuit 121 may include the sense amplifier 410. The sense amplifier 410 may be a separate amplifier distinguished from the source amplifier and may be electrically connected with the other ends of sensing lines 160*a*, 160*b*, 160*c*, and 160*d*. The sense amplifier 410 may apply a first voltage to the sensing lines 160*a*, 160*b*, 160*c*, and 160*d* so as to check cracks in the region including the sensing lines 160*a*, 160*b*, 160*c*, and 160*d*. In this case, all of the first group source switch 190 disposed at the output terminals of the source amplifiers 130 may be turned off.

According to an embodiment, sensing power data 420 may be input to the sense amplifier 410. In an embodiment, the sensing power data 420 may be changed based on a user input. For example, if the electronic device 500 is in the sense mode, the display driver integrated circuit 121 may change the value of the sensing power data 420 based on the user input. In this way, the display driver integrated circuit 121 may adjust the output of the sense amplifier 410 and the magnitude of the first power supply.

According to an embodiment, first group sharing switches 510 may be disposed on the sensing lines 160*a*, 160*b*, 160*c*, and 160*d*. In an embodiment, the first group sharing switches 510 may be disposed between at least some of the first group lines 140 such that at least sub-pixels having the same characteristics are selectively connected with each other. For example, a first sharing switch 511*a* may be disposed between lines connected with red sub-pixels 111_1*a*, 112_1*a*, and 113_1*a* of the n-th gate line, for example, between the first line 141*a* and the fifth line 142*a*. For another example, a second sharing switch 511*b* may be disposed between lines connected with green sub-pixels 111_1*b*, 112_1*b*, and 113_1*b* of the n-th gate line, for example, between the second line 141*b* and the sixth line 142*b*. For yet another example, a third sharing switch 511*c* may be disposed between lines connected with blue sub-pixels 111_1*c*, 112_1*c*, and 113_1*c* of the n-th gate line, for example, between the third line 141*c* and the seventh line 142*c*.

According to an embodiment, since the first group sharing switches 510 connect some of the first group lines 140 according to the characteristics of the sub-pixels, the electronic device 500 may include at least one of the sensing lines 160*a*, 160*b*, 160*c*, and 160*d* according to the characteristics of the sub-pixels. For example, the electronic device 500 may include the first sensing line 160*a* connected with the red sub-pixels 111_1*a*, 112_1*a*, and 113_1*a* of the n-th gate line, the second sensing line 160*b* and the fourth sensing line 160*d* connected with the green sub-pixels 111_1*b*, 112_1*b*, 113_1*b*, 111_1*d*, 112_1*d*, and 113_1*d* of the n-th gate line, and the third sensing line 160*c* connected with the blue sub-pixels 111_1*c*, 112_1*c*, and 113_1*c* of the n-th gate line.

According to an embodiment, first group switches 170*a*, 170*b*, 170*c*, and 170*d* may be disposed on at least one sensing line, respectively. For example, the first switch 170*a* may be disposed between the sense amplifier 410 and the first sharing switch 511*a* on the first sensing line 160*a*. For another example, the second switch 170*b* may be disposed between the sense amplifier 410 and the second sharing switch 511*b* on the second sensing line 160*b*. Similarly to the above, the third switch 170*c* or the fourth switch 170*d* may be disposed on the third sensing line 160*c* or the fourth sensing line 160*d*, respectively.

According to an embodiment, if the electronic device 500 is in the sense mode, the display driver integrated circuit 121 may turn on the first group switches 170*a*, 170*b*, 170*c*, and 170*d* and the first group sharing switches 510 such that the sensing lines 160*a*, 160*c*, and 160*d* are short-circuited from the other ends of the sensing line 160*a*, 160*b*, 160*c*, and 160*d* to the sensing circuit 134. In an embodiment, the display driver integrated circuit 121 may control the first group switches 170*a*, 170*b*, 170*c*, and 170*d* and the first group sharing switches 510 such that each of the sensing lines 160*a*, 160*b*, 160*c*, and 160*d* is sequentially short-circuited according to a specified time interval.

For example, the display diver integrated circuit 121 may control the first group switches 170*a*, 170*b*, 170*c*, and 170*d* and the first group sharing switches 510 such that the first sensing line 160*a* is short-circuited for a first time. If the first voltage is applied from the sense amplifier 410 to the first sensing line 160*a*, the display driver integrated circuit 121 may compare the second voltage obtained by the sensing circuit 134 for the first time with the first voltage to check whether or not the region including the sensing line 160*a* is cracked.

For another example, the display driver integrated circuit 121 may control the first group switches 170*a*, 170*b*, 170*c*, and 170*d* and the first group sharing switches 510 such that the second sensing line 160*b* is short-circuited for a second time that is distinguished from the first time. If the first voltage is applied from the sense amplifier 410 to the second sensing line 160*b*, the display driver integrated circuit 121 may compare the second voltage obtained by the sensing circuit 134 for the second time with the first voltage to check whether or not the region including the sensing line 160*b* is cracked.

For another example, the display driver integrated circuit 121 may control the first group switches 170*a*, 170*b*, 170*c*, and 170*d* and the first group sharing switches 510 such that the first voltage is applied to the third sensing line 160*c* or the fourth sensing line 160*d* for a third time or a fourth time that is distinguished from the first time and the second time.

The display driver integrated circuit 121 may check whether or not at least some region of the electronic device 500 is cracked through the third sensing line 160*c* or the fourth sensing line 160*d*.

In the present disclosure, components having the same reference numerals as those included in the electronic device 500 illustrated in FIG. 5 may be the same as those described in FIG. 5.

Figure 6A:
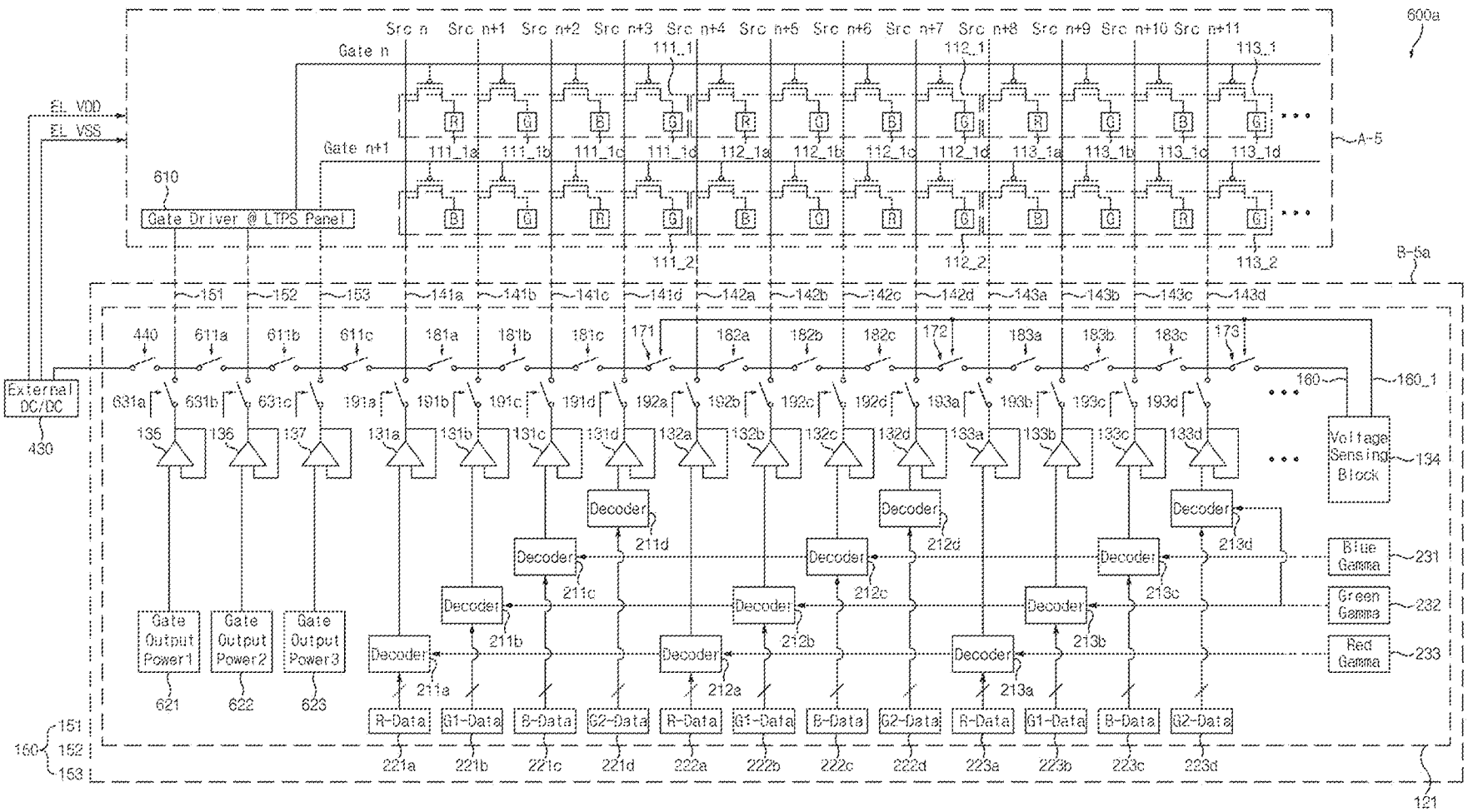
FIG. 6*a* illustrates a detailed circuit diagram of an electronic device for checking cracks in a gate amplifier, according to an embodiment.
Figure 6B:
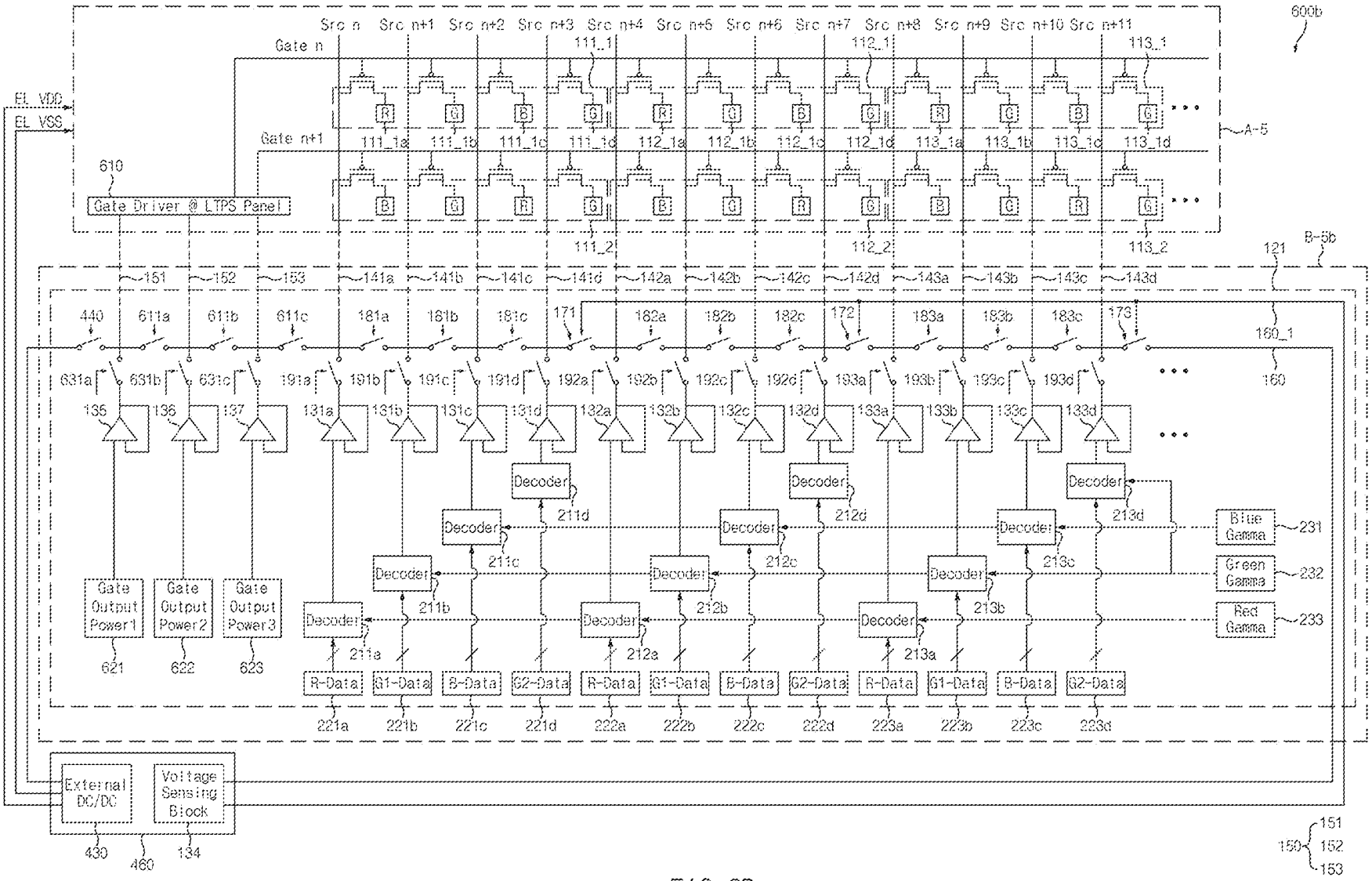
FIG. 6*b* illustrates a detailed circuit diagram of an electronic device for checking cracks in a gate amplifier, according to an embodiment.

FIG. 6*a* and FIG. 6*b* illustrate detailed circuit diagrams of electronic devices for checking cracks in a gate amplifier, according to an embodiment.

Referring to FIG. 6*a*, an electronic device 600*a* may Include a region A-5 and a region B-5*a*. The region A-5 may be understood as an enlarged view of the region A illustrated in FIG. 1, and the region B-5*a* may be understood as an enlarged view of the region B illustrated in FIG. 1. In other words, the region A-5 may represent a portion of the region of the display panel 110, and the region B-5*a* may represent a portion of the connection member 120 on which the display driver integrated circuit 121 is disposed. In the description of FIG. 6*a*, content that has been already shown in the description of FIG. 2 may be omitted.

Referring to A-5, a gate driver 610 and gate lines for providing a gate voltage to each pixel may be disposed on the display panel 110. The gate driver 610 may sequentially apply gate voltages received from gate amplifiers 135, 136, and 137 to respective gate lines. If the gate voltage applied to the gate line, a transistor connected with each of the pixels included in the gate line is active, and a source voltage may be applied to the pixels. The pixels may emit light based on the source voltage.

Referring to B-5, the display driver integrated circuit 121 may include the gate amplifiers 135, 136, and 137 for providing the gate voltage. According to an embodiment, the gate amplifiers 135, 136, and 137 may be electrically connected with pixels of the display panel 110 through the second group lines 150. In an embodiment, the gate driver 610 may be disposed between the second group lines 150. The gate driver 610 may sequentially transmit the gate voltages received through the second group lines 150 to respective gate lines.

According to an embodiment, first group gate switches 631*a*, 631*b*, and 631*c* may be disposed at the output terminals of the gate amplifiers 135, 136, and 137. The first group gate switches 631*a*, 631*b*, and 631*c* may activate or deactivate the outputs of the respective gate amplifiers 135, 136, and 137. For example, if the electronic device 600*a* is in the sense mode for checking cracks in the region including the sensing line 160, the display driver integrated circuit 121 may turn off all of the first group gate switches 631*a*, 631*b*, and 631*c*. In this case, the outputs of the gate amplifiers 135, 136, and 137 may not be applied to the sensing circuit 134, but the first voltage may be applied to the sensing circuit 134 from the external power supply 430. For another example, if the electronic device 600*a* is in the sense mode for sensing an abnormality in the gate amplifiers 135, 136, and 137, the display driver integrated circuit 121 may sequentially turn on the first group gate switches 631*a*, 631*b*, and 631*c* according to a specified time interval. In this case, the outputs of the gate amplifiers 135, 136, and 137 may be sequentially applied one by one to the sensing circuit 134.

According to an embodiment, the second group lines 150 may cross the sensing line 160 like the first group lines 140. In an embodiment, second group sharing switches 611*a*, 611*b*, and 611*c* may be disposed between the second group lines 150. In another embodiment, the second group sharing switches 611*a*, 611*b*, and 611*c* may be disposed between at least one of the second group lines 150 and at least one of the first group lines 140.

According to an embodiment, the electronic device 600*a* may include the external power supply 430 and the power switch 440. The external power supply 430 may be, for example, a power management module (e.g., the power management module 888 of FIG. 8) for supplying power to the display driver integrated circuit 121. For another example, the external power supply 430 may be a power regulator disposed inside the display driver integrated circuit 121 and supplying power to the display panel 110. In an embodiment, the power switch 440 may be disposed between the external power supply 430 and the sensing line 160.

According to an embodiment, the external power supply 430 may include terminal for connection to at least a portion of the display driver integrated circuit 121, for example, general purpose input output (GPIO) terminals. The external power supply 430 may provide the first voltage to at least a portion of the display driver integrated circuit 121, for example, to the other end of the sensing line, through the terminals. In various embodiments, the external power supply 430 may be disposed on the FPCB 11 or the M-PCB 12 illustrated in FIG. 1.

According to an embodiment, if the electronic device 600*a* is in the sense mode for checking cracks in the region including the sensing line 160, the display driver integrated circuit 121 may turn on the power switch 440. The external power supply 430 may apply the first voltage to the sensing line 160 through the power switch 440. In an embodiment, the display driver integrated circuit 121 may turn on the first group switches 170, the first group sharing switches 180, and the second group sharing switches 611*a*, 611*b*, and 611*c* such that the sensing line 160 is short-circuited. In this case, all of the first group gate switches 631*a*, 631*b*, and 631*c* may be turned off. In this way, the first voltage applied from the external power supply 430 may be transmitted to the sensing circuit 134 through the sensing line 160. The display driver integrated circuit 121 may check whether or not the region including the sensing line 160 is cracked through the first voltage and the second voltage obtained through the sensing circuit 134.

According to another embodiment, if the electronic device 600*a* is in the sense mode for sensing an abnormality in the gate amplifiers 135, 136, and 137 or the source amplifiers 130, the display driver integrated circuit 121 may turn off the power switch 440 and may turn on the first group switches 170, the first group sharing switches 180, and the second group sharing switches 611*a*, 611*b*, and 611*c* such that the sensing line 160 is short-circuited. In an embodiment, the display driver integrated circuit 121 may sequentially turn on or off the first group gate switches 631*a*, 631*b*, and 631*c* and the first group source switches 190 one by one according to a specified time interval. In this case, the plurality of gate amplifiers 135, 136, and 137 and the plurality of source amplifiers 130 may sequentially apply the first voltage to the sensing line 160 one by one according to the specified time interval. The display driver integrated circuit 121 may check whether or not the gate amplifiers 135, 136, and 137 and the source amplifiers 130 are abnormal through the first voltage and the second voltage obtained through the sensing circuit 134.

Referring to FIG. 6*b*, an electronic device may include a region A-5 and a region B-5*b*. The region B-5*b* may be understood as an enlarged view of the region B illustrated in FIG. In other words, the region B-5*b* may represent a portion of the connection member 120 in which the display driver integrated circuit is disposed. In the description of FIG. 6*b*, content that has been already shown in the description of FIG. 2 or the description of FIG. 6*a* may be omitted.

According to an embodiment, an electronic device 600*b* may include the sensing module 460, unlike the electronic device 600*a* illustrated in FIG. 6*a*. The sensing module 460 may be understood as an integrated circuit (IC) including the external power supply 430 and the sensing circuit 134. According to an embodiment, the sensing module 460 may be disposed outside the display driver integrated circuit 121, for example, on the FPCB 11 or the M-PCB 12 illustrated in FIG. 1.

According to an embodiment, the sensing module 460 may transmit the specified power to the display driver integrated circuit 121 by using the external power supply 430. For example, the sensing module 460 may apply the first voltage to the sensing line 160 by using the external power supply 430. The external power supply 430 may be, for example, a power management module (e.g., the power management module 888 of FIG. 8) for supplying power to the display driver integrated circuit 121.

According to an embodiment, the sensing module 460 may check whether or not the gate amplifiers 135, 136, and 137 and the source amplifiers 130 are abnormal by using the sensing circuit 134. For example, the sensing module 460 may obtain the magnitude of the second voltage measured at one end of the sensing line 160 by using the sensing circuit 134. The sensing module 460 may check whether or not the gate amplifiers 135, 136, and 137 and the source amplifiers 130 are abnormal through the first voltage and the second voltage.

In the present disclosure, components having the same reference numerals as those included in the electronic device 600*a* illustrated in FIG. 6*a* or the electronic device 600*b* illustrated in FIG. 6*b* are the same as those described in FIG. 6*a* or FIG. 6*b*.

Figure 7A:
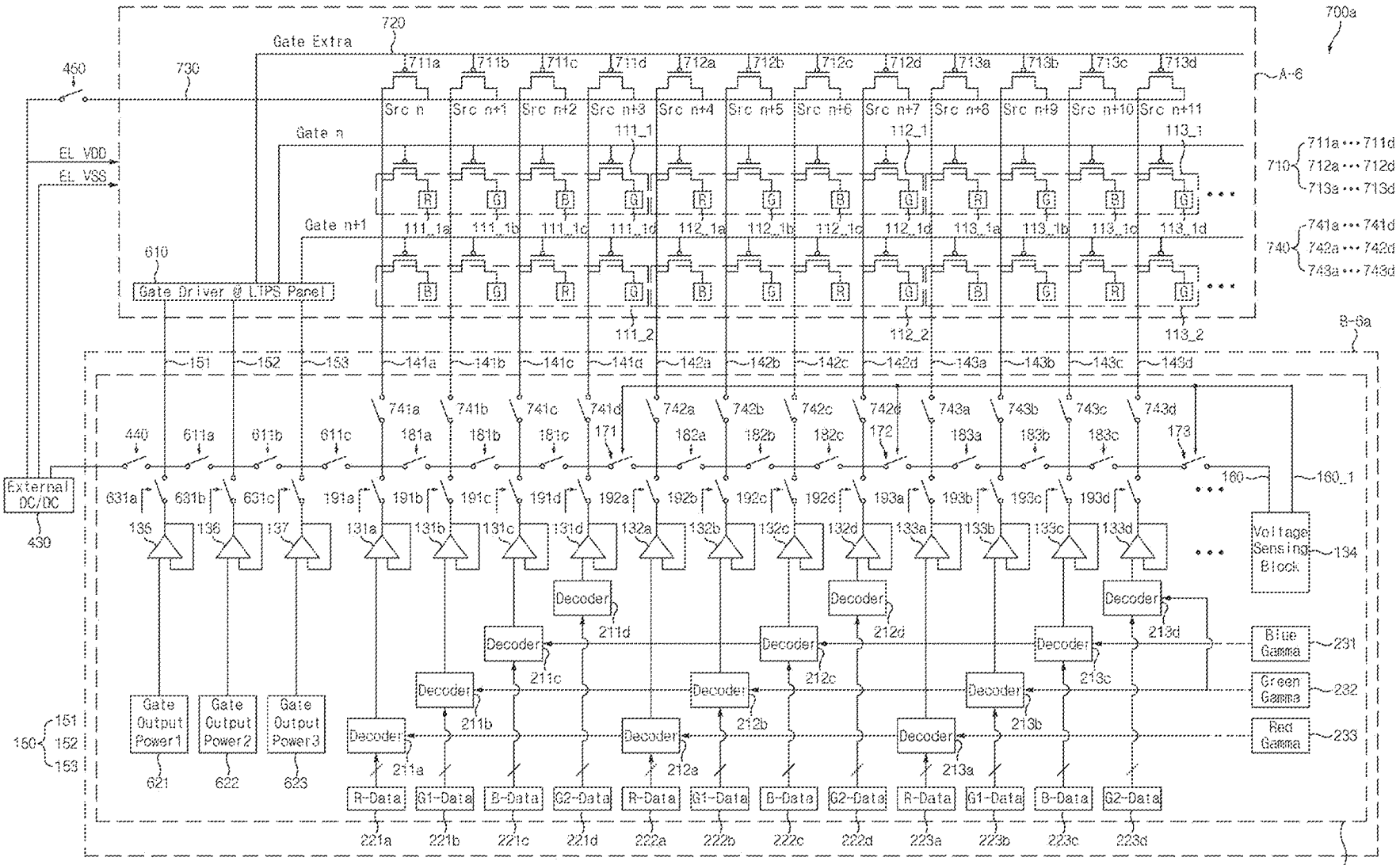
FIG. 7*a* illustrates a detailed circuit diagram of an electronic device for checking cracks in a display panel, according to an embodiment.
Figure 7B:
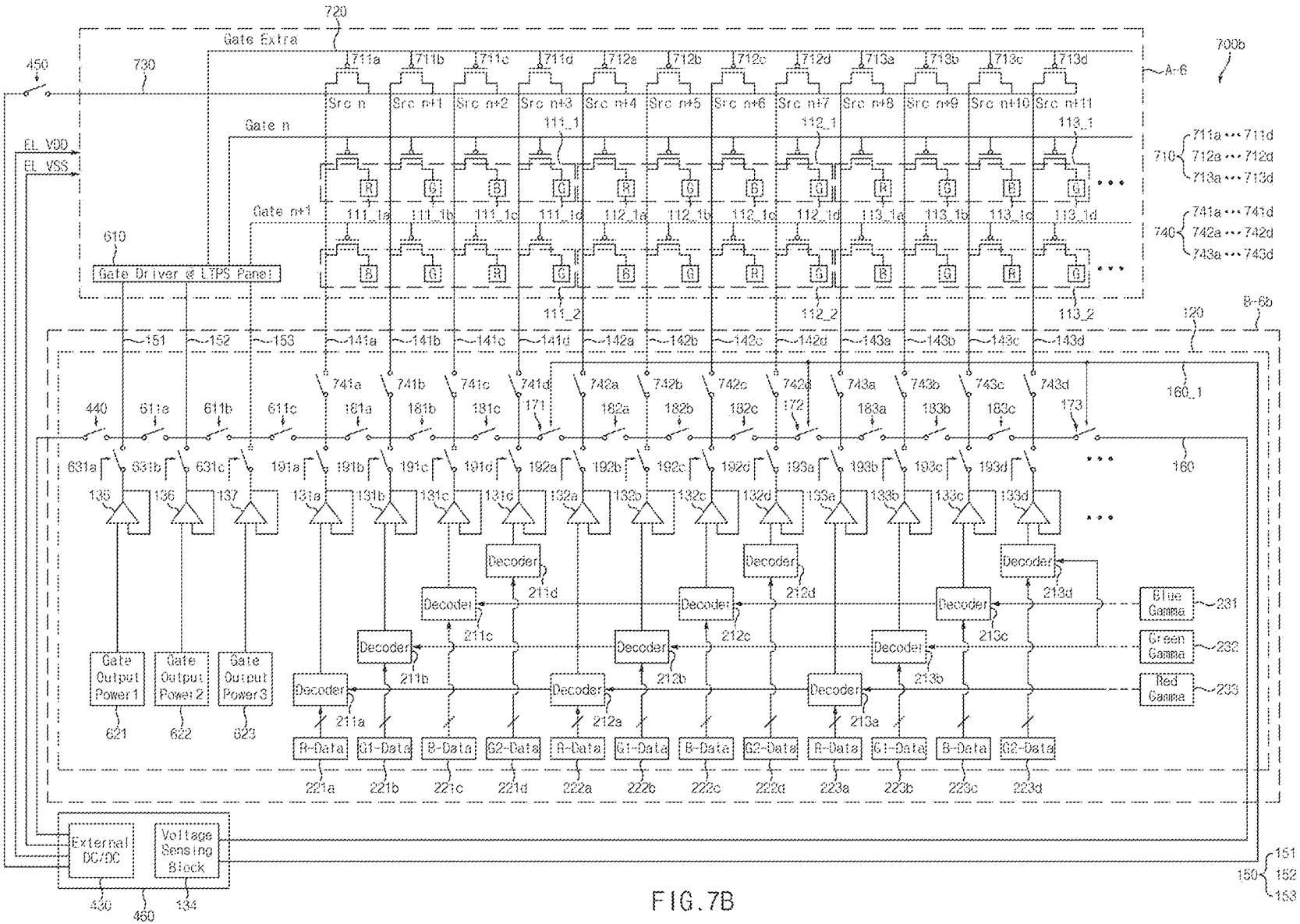
FIG. 7*b* illustrates a detailed circuit diagram of an electronic device for checking cracks in a display panel, according to an embodiment.

FIG. 7*a* and FIG. 7*b* illustrated detailed circuit diagrams of electronic devices for checking cracks in a display panel, according to an embodiment.

Referring to FIG. 7*a*, an electronic device 700*a* may include a region A-6 and a region B-6*a*. The region A-6 may be understood as an enlarged view of the region A illustrated in FIG. 1, and the region B-6*a* may be understood as an enlarged view of the region B illustrated in FIG. 1. In other words, the region A-6 may represent a portion of the region of the display panel 110, and the region B-6*a* may represent a portion of the connection member 120 on which the display driver integrated circuit 121 is disposed. In the description of FIG. 7*a*, content that has been already shown in the descriptions of FIG. 2 and FIG. 6*a* may be omitted.

Referring to A-6, first group transistors 710 may be additionally disposed at one end of the display panel 110. According to an embodiment, the first group transistors 710 may be electrically connected one ends of the first group lines 140. In an embodiment, the first group transistors 710 may not be connected with the light emitting device unlike other transistors disposed on the display panel 110. For example, the first group transistors 710 may be electrically connected with the external power supply 430, instead of the light emitting device, through a power supply line 730.

According to an embodiment, a separate gate line 720 may be additionally connected with the first group transistors 110. For example, the separate gate line 720 is electrically connected with the gate terminals of the first group transistors 710, and the first group transistors 710 may receive a gate voltage through the separate gate line 720.

Referring to B-6, the display driver integrated circuit 121 may include second group switches 740. According to an embodiment, the second group switches 740 may be disposed on the first group lines 140 and may short-circuit or open the first group lines 140. For example, if the electronic device 700*a* is not in the sense mode, the second group switches 740 may be turned on, and the first group lines 140 may be short-circuited. The pixels may receive the source voltage through the first group lines 140. For another example, if the electronic device 700*a* is in the sense mode for checking an abnormality in the display panel 110, at least some of the second group switches 740 may be turned on and the remaining portion of the second group switches 740 may be turned off. In this case, at least some of the first group Lines 140 may be short-circuited and the remaining portion of the first group lines 140 may be opened. In an embodiment, the first voltage applied from the external device through the first group transistors 710 may be applied to the sensing line 160 through the short-circuited lines.

According to an embodiment, the electronic device 700*a* may include the external power supply 430, a first power switch 440, and a second power switch 450. The external power supply 430 may be, for example, a power management module (e.g., the power management module 888 of FIG. 8) for supplying power to the display driver integrated circuit 121. For another example, the external power supply 430 may be a power regulator disposed inside the display drier integrated circuit 121 and supplying power to the display panel 110. In an embodiment, the first power switch 440 may be disposed between the external power supply 430 and the sensing, line 160, and the second power switch 450 may be disposed between the external power supply 430 and the power supply line 730.

According to an, embodiment, the external power supply 430 may include terminals for connection to at least a portion of the display driver integrated circuit 121, for example, general purpose input output (GPIO) terminals. The external power supply 430 may provide the first voltage to at least a portion of the display driver integrated circuit 121, for example, to the other end, of the sensing line, through the terminals. According to various embodiments, the external power supply 430 may be disposed on the FPCB 11 or the M-PCB 12 illustrated in FIG. 1.

According to an embodiment, the first power switch 440 or the second power switch 450 may be selectively turned on. For example, if the electronic device 700*a* is in the sense mode for checking cracks in the region including the sensing line 160, the first power switch 440 may be turned on and the second power switch 450 may be turned off. For another example, if the electronic device 700*a* is in the sense mode for checking an abnormality in the display panel 110, the first power switch 440 may be turned off and the second power switch 450 may be turned on.

According to an embodiment, if the electronic device 700*a* is in the sense mode for checking an abnormality in the display panel 110, the display driver integrated circuit 121 may apply the gate voltage to the first group transistors 710 through the separate gate line 720 by using the gate amplifiers 135, 136, and 137. If the gate voltage is applied to the first group transistors 710, the first group transistors 710 may be turned on. The turned-on first group transistors 710 may transmit, to the first group lines 140, the first voltage applied from the external power supply 430 through the power supply line 730.

According to an embodiment, if the electronic device 700*a* is in the sense mode for checking an abnormality in the display panel 110, the display driver integrated circuit 121 may turn on at least some of the second group switches 740. In this case, some of the first group lines 140 may be short-circuited through the turned-on second group switches 740, and the first voltage may be applied to the sensing line 160. In this case, the display driver integrated circuit 121 may check whether or not pixels or sub-pixels included in the short-circuited first group lines 140 are abnormal by using the first voltage and the second voltage obtained through the sensing circuit 134.

According to an embodiment, if the electronic device 700*a* is in the sense mode for checking cracks in the display panel 110, the display driver integrated circuit 121 may sequentially turn on any one of the second group switches 740 according to a specified time interval. In this case, any one of the first group lines 140 may be sequentially turned on according to the specified time interval. The display driver integrated circuit 121 may sequentially check whether or not pixels or sub-pixels are abnormal by using the first voltage and the second voltage corresponding to the first voltage according to the specified time interval.

Referring to FIG. 7*b*, an electronic device may include a region A-6 and a region B-6*b*. The region B-6*b* may be understood as an enlarged view of the region B illustrated in FIG. 1. In other words, the region B-6*b* may represent a portion of the connection member 120 in which the display driver integrated circuit 121 is disposed. In the description of FIG. 7*b*, content that has been already shown in the description of FIG. 2 or the description of FIG. 7*a* may be omitted.

According to an embodiment, the electronic device 700*b* may include the sensing module 460, unlike the electronic device 700*a* illustrated in FIG. 7*a*. The sensing module 460 may be understood as an integrated circuit (IC) including the external power supply 430 and the sensing circuit 134. According to an embodiment, the sensing module 460 may be disposed outside the display driver integrated circuit 121, for example, on the FPCB 11 or the M-PCB 12 illustrated in FIG. 1.

According to an embodiment, the sensing module 460 may transmit the specified power to the display driver integrated circuit 121 by using the external power supply 430. For example, the sensing module 460 may apply the first voltage to the sensing line 160 by using the external power supply 430. The external power supply 430 may be, for example, a power management module (e.g., the power management module 888 of FIG. 8) for supplying power to the display driver integrated circuit 121.

According to an embodiment, the sensing module 460 may check whether or not pixels or sub-pixels are abnormal using the sensing circuit 134. For example, the sensing module 460 may obtain the magnitude of the second voltage measured, at one cup of the sensing line 160 by using the sensing circuit 134. The sensing module 460 may check whether or not pixels or sub-pixels are abnormal through the first voltage and the second voltage.

Figure 8:
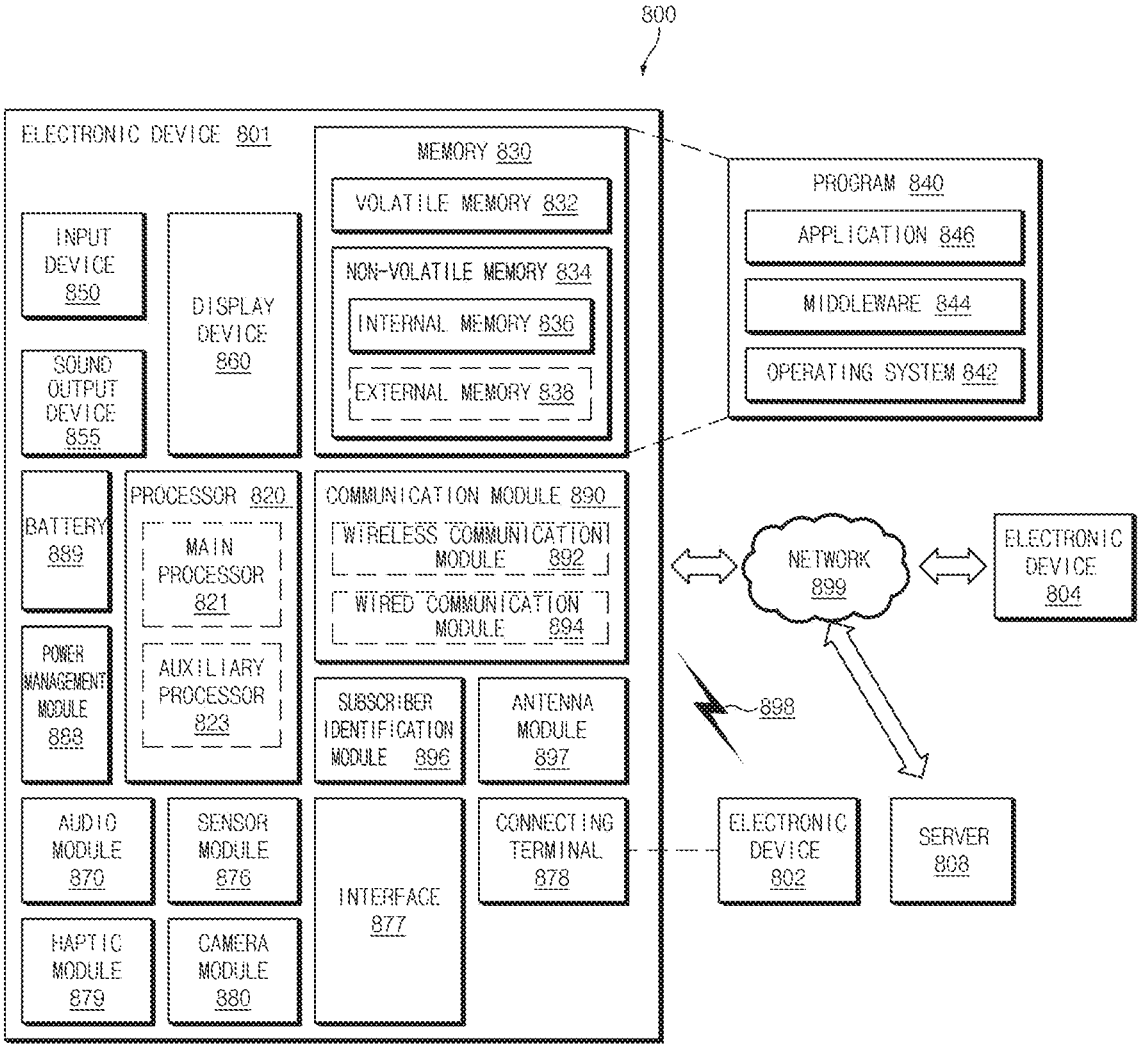
FIG. 8 is a block diagram illustrating an electronic device in a network environment according to various embodiments.

FIG. 8 is a block diagram illustrating an electronic device 801 in, a network environment 800 according to various embodiments. Referring to FIG. 8, the electronic device 801 in the network environment 800 may communicate with an electronic device 802 via a first network 898 (e.g., a short-range wireless communication network), or an electronic device 804 or a server 808 via a second network 899 (e.g., a long-range wireless communication network). According to an embodiment, the electronic device 801 may communicate with the electronic device 804 via the server 808. According to an embodiment, the electronic device 801 may include a processor 820, memory 830, an input device 850, a sound, output device 855, a display device 860, an audio module 870, a sensor module 876, an interface 877, a haptic module 879, a camera module 880, a power management module 888, a battery 889, a communication module 890, a subscriber identification module (SIM) 896, or an antenna module 997. In some embodiments, at least one (e.g., the display device 860 or the camera module 880) of the components may be omitted from the electronic device 801, or one or more other components may be added in the electronic device 301. In some embodiments, some of the components may be implemented as single integrated circuitry. For example, the sensor module 876 (e.g., a fingerprint sensor, an iris sensor, or an illuminance sensor) may be implemented as embedded in the display device 860 (e.g., a display).

The processor 820 may execute, for example, software (e.g., a program 840) to control one other component (e.g., a hardware or software component) of the electronic device 801 coupled with the processor 820, and may perform various data processing of computation. According to one embodiment, as at least part of the data processing or computation, the processor 820 may load a command or data received from another component (e.g., the sensor module 876 or the communication module 890) in volatile memory 832, process the command or the data stored in the volatile memory 932, and store resulting data in non-volatile memory 834. According to an embodiment, the processor 820 may include a main processor 821 (e.g., a central processing unit (CPU) or an application processor (AP)), and an auxiliary processor 323 (e.g., a graphics processing unit (GPU), an image signal processor (ISP), a sensor hub processor, or a communication processor (CP)) that is operable independently from, or in conjunction with, the main processor 821. Additionally or alternatively, the auxiliary processor 823 may be adapted to consume less power than the main processor 821, or to be specific to a specified function. The auxiliary processor 823 may be implemented as separate from, or as part of the main processor 821.

The auxiliary processor 823 may control at least some of functions or states related to at least one component the display device 860, the sensor module 876, or the communication module 890) among the components of the electronic device 801, instead of the main processor 821 while the main processor 821 is in an inactive (e.g., sleep) state, or together with the main processor 821 while the main processor 821 is in an active state (e.g., executing an application). According to an embodiment, the auxiliary processor 823 (e.g., an image signal processor or a communication processor) may be implemented as part of another component the (e.g., the camera module 880 or the communication module 890) functionally related to the auxillary processor 823.

The memory 830 may store various data used by at least one component (e.g., the processor 820 or the sensor module 876) of the electronic device 801. The various data may include, for example, software (e.g., the program 840) and input data or output data for a command related thererto. The memory 830 may include the volatile memory 832 or the non-volatile memory 834.

The program 840 may be stored in the memory 830 as software, and may include, for example, an operating system (OS) 842, middleware 844, or an application 846.

The input device 850 may receive a command or data to be used by other component (e.g., the processor 820) of the electronic device 801, from the outside (e.g., a user) of the electronic device 801. The input device 850 may include, for example, a microphone, a mouse, or a keyboard.

The sound output device 855 may output sound signals to the outside of the electronic device 801. The sound output device 855 may include, for example, a speaker or a receiver. The speaker may be used for general purposes, such as playing multimedia or playing record, and the receiver may be used for an incoming calls. According to an embodiment, the receiver may implemented as separate from, or as part of the speaker.

The display device 860 may visually provide information to the outside (e.g., a user) of the electronic device 801. The display device 860 may include, for example, a display, a hologram device, or a projector and control circuitry to control a corresponding one of the display, hologram device, and projector. According to an embodiment, the display device 860 may include touch circuitry adapted to detect a touch, or sensor circuitry (e.g., a pressure sensor) adapted to measure the intensity of force incurred by the touch.

The audio module 870 may convert a sound into an electrical signal and vice versa. According to an embodiment, the audio module 870 may obtain the sound via the input device 850, or output the sound via the sound output device 855 or a headphone of an external electronic device (e.g., an electronic device 802) directly (e.g., wiredly) or wirelessly coupled with the electronic device 801.

The sensor module 876 may detect an operational state (e.g., power or temperature) of the electronic device 801 or an environmental state (e.g., a state of user) external to the electronic device 801, and then generate an electrical signal or data value corresponding to the detected state. According to an embodiment, the sensor module 876 may include, for example, a gesture sensor, a gyro sensor, an atmospheric pressure sensor, a magnetic sensor, an acceleration sensor, a grip sensor, a proximity sensor, color sensor, an infrared (IR) sensor, a biometric sensor, a temperature sensor, a humidity sensor, or an illuminance sensor.

The interface 877 may support one or more specified protocols to be used for the electronic device 801 to be coupled with the external electronic device (e.g., the electronic device 802) directly (e.g., wiredly) or wirelessly. According to an embodiment, the interface 877 may include, for example, a high definition multimedia interface (HDMI), a universal serial bus (USB) interface, a secure digital (SD) card interface, or an audio interface.

A connecting terminal 878 may include a connector via which the electronic device 801 may be physically connected with the external electronic device (e.g., the electronic device 802). According to an embodiment, the connecting terminal 878 may include, for example, a HDMI connector, a USE connector, a SD card connector, or an audio connector (e.g., a headphone connector).

The haptic module 879 may convert an electrical signal into a mechanical stimulus (e.g., a vibration or a movement) or electrical stimulus which may be recognized by a user via his tactile sensation or kinesthetic sensation. According to an embodiment, the haptic module 879 may include, for example, a motor, a piezoelectric element, or an electric stimulator.

The camera module 880 may capture a still image or moving images. According to an embodiment, the camera module 880 may include or more lenses, image sensors, image signal processors, or flashes.

The power management module 888 may manage power supplied to the electronic device 801. According to one embodiment, the power management module 888 may be implemented as at least part of, for example, a power management integrated circuit (PMIC).

The battery 889 may supply power to at least one component of the electronic device 801. According to an embodiment, the battery 889 may include, for example, a primary cell which is not rechargeable, a secondary cell which is rechargeable, or a fuel cell.

The communication module 890 may support establishing a direct (e.g., wired) communication channel or a wireless communication channel between the electronic device 801 and the external electronic device (e.g., the electronic device 802, the electronic device 804, or the server 808) and performing communication via the established communication channel. The communication module 890 may include one or more communication processors that are operable independently from the processor 820 (e.g., the application processor (AP)) and supports a direct (e.g., wired) communication or a wireless communication. According to an embodiment, the communication module 890 may include a wireless communication module 892 (e.g., a cellular communication module, a short-range wireless communication module, or a global navigation satellite system (GNSS) communication module) or a wired communication module 894 (e.g., a local area network (LAN) communication module or a power line communication (PLC) module). A corresponding one these communication modules may communicate with the external electronic device via the first network 898 (e.g., a short-range communication network, such as Bluetooth™, wireless-fidelity (Wi-Fi) direct, or infrared data association (IrDA)) or the second network 899 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 892 may identify and authenticate the electronic device 801 in a communication network, such as the first network 898 or the second network 899, using subscriber information (e.g., international mobile subscriber identity (IMSI)) stored in the subscriber identification module 896.

The antenna module 897 may transmit or receive a signal or power to or from the outside (e.g., the external electronic device) of the electronic device 801. According to an embodiment, the antenna module 897 may include one or more antennas, and, therefrom, at least one antenna appropriate for a communication scheme used in the communication network, such as the first network 898 or the second network 899, may be selected, for example, by the communication module 890 (e.g., the wireless communication module 892). The signal or the power may then be transmitted or received between the communication module 890 and the external electronic device via the selected at least one antenna.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 801 and the external electronic device 804 via the server 808 coupled with the second network 899. Each of the electronic devices 802 and 804 may be a device of a same type as, or a different type, from the electronic device 801. According to an embodiment, all or some of operations to be executed at the electronic device 801 may be executed at one or more of the external electronic devices 802, 804, or 808. For example, if the electronic device 801 should perform a function or a service automatically, or in response to a request from user or another device, the electronic device 801, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 801. The electronic device 801 may provide the outcome, with or without further processing of the outcome, as at least part of a reply to the request. To that end, a cloud computing, distributed computing, or client-server computing technology may be used, for example.

Figure 9:
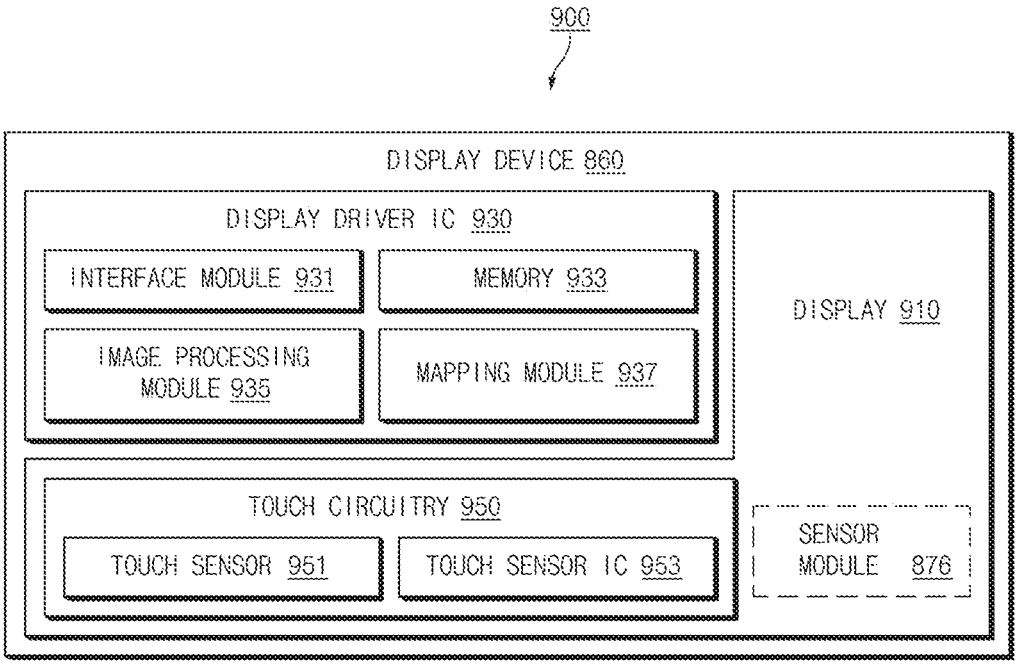
FIG. 9 is a block diagram illustrating the display device according to various embodiments.

FIG. 9 is a block diagram 900 illustrating the display device 860 according to various embodiments. Referring to FIG. 9, the display device 860 may include a display 910 and a display driver integrated circuit (DDI) 930 to control the display 910. The DDI 930 may include an interface module 931, memory 933 (e.g., buffer memory), an image processing module 935, or a mapping module 937. The DPI 930 may receive image information that contains image data or an image control signal corresponding to a command to control the image data from another component of the electronic device 801 via the interface module 931. For example, according to an embodiment, the image information may be received from the processor 820 (e.g., the main processor 821 (e.g., an application processor)) or the auxiliary processor 823 (e.g., a graphics processing unit) operated independently from the function of the main processor 821. The DDI 930 may communicate, for example, with touch circuitry 850 or the sensor module 876 via the interface module 931. The DDI 930 may also store at least part of the received image information in the memory 933, for example, on a frame by frame basis.

The image processing, module 935 may perform pre-processing or post-processing (e.g., adjustment of resolution, brightness, or size) with respect to at least part of the image data. According to an embodiment, the pre-processing or post-processing may be performed, for example, based at least in part on one or more characteristics of the image data or one or more characteristics of the display 910.

The mapping module 937 may generate a voltage value or a current value corresponding to the image data pre-processed or post-processed by the image processing module 935. According to an embodiment, the generating of the voltage value or current value may be performed, for example, based at least in part on one or more attributes of the pixels (e.g., an array, such as an RGB stripe or a pentile structure, of the pixels, or the size of each subpixel). At least some pixels of the display 910 may be driven, for example, based at least in part on the voltage value or the current, value such that visual information (e.g., a text, an image, or an icon) corresponding to the image data may be displayed via the display 910.

According to an embodiment, the display device 860 may further include the touch circuitry 950. The touch circuitry 950 may include a touch sensor 951 and a touch sensor IC 953 to control the sensor 951. The touch sensor IC 953 may control the touch sensor 951 to sense a touch input or a hovering input with respect to a certain position on the display 910. To achieve this, for example, the touch sensor 951 may detect (e.g., measure) a change in a signal (e.g., a voltage, a quantity of light, a resistance, or a quantity of one or more electric charges) corresponding to the certain position on the display 910. The touch circuitry 950 may provide input information (e.g., a position, an area, a pressure, or a time) indicative of the touch input or the hovering input detected via the touch sensor 951 to the processor 820. According to an embodiment, at least part (e.g., the touch sensor IC 953) of the touch circuitry 950 may be formed as part of the display 910 or the DDI 930, or as part of another component (e.g., the auxiliary processor 823) disposed outside the display device 860.

According to an embodiment, the display device 860 may further include at least one sensor (e.g., a fingerprint sensor, an iris sensor, a pressure sensor, or an illuminance sensor) of the sensor module 876 or a control circuit for the at least one sensor. In such a case, the at least one sensor or the control circuit for the at least one sensor may be embedded in one portion of a component (e.g., the display 910, the DDI 930, or the touch circuitry 850)) of the display device 860. For example, when the sensor module 876 embedded in the display device 860 includes a biometric sensor (e.g., a fingerprint sensor), the biometric sensor may obtain biometric, information (e.g., a fingerprint image) corresponding to a touch input received via a portion of the display 910. As another example, when the sensor module 876 embedded in the display device 860 includes a pressure sensor, the pressure sensor may obtain pressure information corresponding to a touch input received via a partial or whole area of the display 910. According to an embodiment, the touch sensor 951 or the sensor module 876 may be disposed between pixels in a pixel layer of the display 910, or over or under the pixel layer.

An electronic device according to an embodiment of the present disclosure may include a display panel on which a plurality of pixels are arranged, first group lines providing a source voltage to each of the plurality of pixels, a display driver integrated circuit that includes a plurality of source amplifiers electrically connected with the first group lines and providing the source voltage to each of the plurality of pixels, at least one sensing line crossing the first group lines, and first group switches disposed on the at least one sensing line, and a sensing circuit electrically connected with one end of the at least one sensing line to check a crack in at least a partial region of the electronic device, in which the display driver integrated circuit receives a specified signal for the electronic device to enter a sense mode, applies a first voltage to the other end of the at least one sensing line that is distinguished from the one end of the at least one sensing line, in response to the received specified signal, turns on the first group switches such that the at least one sensing line is short-circuited from the other end of the at least one sensing line to the sensing circuit, obtains a second voltage sensed by the sensing circuit electrically connected with the one end of the at least one sensing line, and checks information regarding the crack in the at least partial region of the electronic device based on a difference between the first voltage and the second voltage.

According to an embodiment, the display driver integrated circuit may apply the first voltage to the other end of the at least one sensing line by using any one of the plurality of source amplifiers, in response to the received specified signal.

According to an embodiment, the plurality of source amplifiers may further include first group source switches respectively disposed at output terminals of the plurality of source amplifiers, and the display driver integrated circuit may turn on the source switch disposed at the output terminal of any one of the source amplifiers among the first group source switches, in response to the received specified signal.

According to an embodiment, the display driver integrated circuit may further include a multiplexer electrically connected with an input terminal of any one of the source amplifiers, and may adjust a magnitude of the output voltage of the one of the source amplifiers by using the multiplexer.

According to an embodiment, the display driver integrated circuit may sequentially app the first voltage to the other end of the at least one sensing line by sequentially using the plurality of source amplifiers one by one according to a specified time interval, and may sequentially check whether or not each of the plurality of source amplifiers is abnormal based on the difference between the first voltage and the second voltage, according to the specified time interval. According to an embodiment, the plurality of source amplifiers may further include first group source switches respectively, disposed at output terminals of the plurality of source amplifiers, and the display driver integrated circuit may sequentially apply the first voltage to the other end of the at least one sensing line according to the specified time interval by sequentially turning on the first group source switches one by one according to the specified time interval.

According to an embodiment, the display driver integrated circuit may further include sense amplifier electrically connected with the other end of the at least one sensing line, and may apply the first voltage to the other end of the at least one sensing line by using the sense amplifier, in response to the received specified signal.

According to an embodiment, the display driver integrated circuit may further include a multiplexer electrically connected with an input terminal of the sense amplifier, and may adjust a magnitude of the output voltage of the sense amplifier by using the multiplexer.

According to an embodiment, the electronic device may further include an external power supply electrically connected with the other end of the at least one sensing line, and the display driver integrated circuit may apply the first voltage to the other end of the at least one sensing, line by using the external power supply.

According to an embodiment, the display driver integrated circuit may further include a power switch disposed between the external power supply and the at least one sensing line, and may turn on the power switch such that the first voltage is applied to the other end of the at least one sensing line from the external power supply in response to the received specified signal.

According to an embodiment, the electronic device may further include second group lines crossing the at least one sensing line and providing a gate voltage to each of the plurality of pixels, the display driver integrated circuit may further include a plurality of gate amplifiers electrically connected with the second group lines and providing the gate voltage to each of the plurality of pixels, may sequentially apply the first voltage to the other end of the at least one sensing line by sequentially using the plurality of source amplifiers and the plurality of gate amplifiers one by one according to a specified time interval, and may sequentially check whether or not the plurality of source amplifiers and the plurality of gate amplifiers are abnormal based on the difference between the first voltage and the second voltage, according to the specified time interval.

According to an embodiment, the plurality of source amplifiers may further include first group source switches respectively disposed at output terminals of the plurality of source amplifiers, the plurality of gate amplifiers may further include first group gate switches respectively disposed at output terminals of the plurality of gate amplifiers, and the display driver integrated circuit may sequentially apply the first voltage to the other end of the at least one sensing line according to the specified time interval by sequentially turning on the first group source switches and the first group gate switches one by one according to the specified time interval.

According to an embodiment, the electronic device may further include an external power supply supplying a specified voltage, the display panel may further include first group transistors electrically connecting the external power supply with each of the first group lines, the display driver integrated circuit may further include a gate amplifier for applying a gate voltage to gate terminals of the first group transistors, and second group switches disposed on the first group lines to selectively connect the first group transistors with at least one sensing line, and the display driver integrated circuit may apply the gate voltage to the gate terminals of the first group transistors by using the gate amplifier such that the first group transistors are turned on in response to the received specified signal, may sequential turn on the second group switches one by one according to the specified time interval, may sequentially apply the first voltage to the other end of the at least one sensing line through any one of the first group transistors and any one of the first group lines by using the external power supply according to the specified interval, and may sequentially check whether or not the plurality of pixels are cracked based on the difference between the first voltage and the second voltage, according to the specified time interval.

According to an embodiment, each of the plurality of pixels may include a plurality of sub-pixels electrically connected with the source amplifiers through the first group lines, and the display driver integrated circuit may further include first group sharing switches disposed between at least some of the first group lines on the sensing line such that the sub-pixels included in any one of the plurality of pixels are selectively connected with each other, and may turn on the first group switches and the first group sharing switches such that the at least one sensing line is short-circuited from the other end of the at least one sensing line to the sensing circuit.

According to an embodiment, each of the plurality of pixels may include plurality of sub-pixels electrically connected with the source amplifiers through the first group lines, and the display driver integrated circuit may further include first group sharing switches disposed between at least some of the first group lines on the sensing line such that at least sub-pixels having the same characteristic among the plurality of sub-pixels are selectively connected with each other, and may turn on the first group switches and the first group sharing switches such that the at least one sensing line is short-circuited from the other end of the at least one sensing line to the sensing circuit.

A display according to an embodiment of the present disclosure may include a display panel including a plurality of pixels each including a plurality of sub-pixels, a plurality of source amplifiers electrically connected with the plurality of sub-pixels, first group source switches disposed on an electrical path between the output terminals of the plurality of source amplifiers and the plurality of sub-pixels, first group sharing switches selectively connecting the plurality of sub-pixels included in each of the plurality of pixels with each other, first group switches selectively connecting the plurality of pixels with each other, a sensing circuit selectively connected with the plurality of sub pixels or the plurality of source amplifiers through the first group source switches, the first group sharing switches, and the first group switches, and a display driver integrated circuit electrically connected with input terminals of the plurality of source amplifiers and the sensing circuit, in which the display driver integrated circuit may be configured to supply a first voltage to a first source amplifier of the plurality of source amplifiers in a state in which a first source switch corresponding to the first amplifier, at least some of the first group sharing switches, and at least some of the first group switches are turned on, sense a second voltage obtained by transmitting the first voltage to the sensing circuit through the specified first source switch, the at least some of the first group sharing switches, and the at least some of the first group switches by using the sensing circuit and check information regarding a crack in the display at least based on the sensed second voltage.

According to an embodiment, the display driver integrated circuit may be configured to supply the specified voltage to the specified source amplifier in a state in which remaining source switches other than the source switch among the first group source switches are turned on.

According to an embodiment, the display driver integrated circuit may be configured to supply a third voltage to second source amplifier of the plurality source amplifiers in a state in which a second source switch corresponding to the second amplifier, at least some of the first group sharing switches, and at least some of the first group switches, sense a fourth voltage obtained by transmitting the first voltage to the sensing circuit through the specified first source, the at least some of the first group sharing switches, and the at least some of the first group switches, and check information regarding a crack in the display at least based on the sensed second voltage and the sensed fourth voltage.

A display according to an embodiment of the present disclosure may including a display panel that includes a plurality of pixels including a plurality of sub-pixels, one or more source amplifiers electrically connected with the plurality of sub-pixels, a power supply electrically connected with output terminals of the plurality of sub-pixels and the one or more source amplifiers, first group sharing switches selectively connecting the plurality of sub-pixels included in each of the plurality of pixels, first group switches selectively connecting the plurality of pixels with each other, a sensing circuit selectively connected with the plurality of sub-pixels or the one or more source amplifiers through the first group sharing switches and the first group switches, and a display driver integrated circuit electrically connected with input terminals of the one or more source amplifiers and the sensing circuit, in which the display driver integrated circuit may be configured to turn on at least some of the first group sharing switches and at least some of the first group switches, sense a second voltage obtained by transmitting the first voltage supplied from the power supply device to the sensing circuit through the at least some of the first group sharing switches and the at least some of the first group switches, and check information regarding a crack in the display at least based on the sensed second voltage.

According to an embodiment, the electronic device may further include a power switch disposed at an output terminal of the power supply, and the display driver integrated circuit may turn on the power switch such that the first voltage is supplied from the power supply.

According to embodiments disclosed in the present disclosure, an electronic device may check cracks in display even in the final assembly step. In this way, a defective rate for an electronic device provided to a user may be reduced.

The electronic device according to various embodiments may be one of various types of electronic devices. The electronic devices may include, for example, a portable communication device (e.g., a smart phone), a computer device, portable multimedia device, a port e medical device, camera, a wearable device or a home appliance. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding, one of the phrases. As used herein, such terms as "1st" and "2nd," or "first" and "second" may be used to simply distinguish a corresponding component from another, and does not limit the components in other aspect importance or order). It is to be understood that if an element (e.g., a first element) is "communicatively", as "coupled with," "coupled to," "connected with," or "connected to" another element (e.g., a second element), it means that the element may be coupled with the other element directly (e.g., wiredly), wirelessly or via a third element.

As used her in, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 840) including one or more instructions that are stored in a storage medium (e.g., internal memory 836 or external memory 838) that is readable by a machine (e.g., the electronic device 801). For example, a processor (e.g., the processor 820) of the machine (e.g., the electronic device 801) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage media and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

The invention claimed is:

1. An electronic device comprising:

a display panel on which a plurality of pixels are arranged;

first group lines providing a source voltage to each of the plurality of pixels;

a display driver integrated circuit that includes a plurality of source amplifiers electrically connected with the first group lines and providing the source voltage to each of the plurality of pixels, at least one sensing line crossing the first group lines, and first group switches disposed on the at least one sensing line; and a sensing circuit electrically connected with one end of the at least one sensing line to check a crack in at least partial region of the electronic device, wherein the display driven integrated circuit:

receives a specified signal for the electronic device to enter a sense mode;

applies a first voltage to the other end of the at least one sensing line that is distinguished from the one end of the at least one sensing line, in response to the received specified signal;

turns on the first group switches such that the at least one sensing line is short-circuited from the other end of the at least one sensing line to the sensing circuit;

obtains a second voltage sensed by the sensing circuit electrically connected with the one end of the at least one sensing line; and checks information regarding the crack in the at least partial region of the electronic device based on a difference between the first voltage and the second voltage.

2. The electronic device of claim 1, wherein the display driver integrated circuit applies the first voltage to the other end of the at least one sensing line by using any one of the plurality of source amplifiers, in response to the received specified signal.

3. The electronic device of claim 2, wherein the plurality of source amplifiers further include first group source switches respectively disposed at output terminals of the plurality of source amplifiers, and the display driver integrated circuit turns on the source switch disposed at the output terminal of any one of the source amplifiers among the first group source switches, in response to the received specified signal.

4. The electronic device of claim 2, wherein the display driver integrated circuit:

further includes a multiplexer electrically connected with an input terminal of any one of the source amplifiers, and adjusts a magnitude of the output voltage of the one of the source amplifiers by using the multiplexer.

5. The electronic device of claim 2, wherein the display driver integrated circuit:

sequentially applies the first voltage to the other end of the at least one sensing line by sequentially using the plurality of source amplifiers one by one according to a specified time interval, and sequentially checks whether or not each of the plurality of source amplifiers is abnormal based on the difference between the first voltage and the second voltage, according to the specified time interval.

6. The electronic device of claim 5, wherein the plurality of source amplifiers further include first group source switches respectively disposed at output terminals of the plurality of source amplifiers, and the display driver integrated circuit sequentially applies the first voltage to the other end of the at least one sensing line according to the specified time interval by sequentially turning on the first group source switches one by one according to the specified time interval.

7. The electronic device of claim 1, wherein the display driver integrated circuit:

further includes a sense amplifier electrically connected with the other end of the at least one sensing line, and applies the first voltage to the other end of the at least one sensing line by using the sense amplifier, in response to the received specified signal.

8. The electronic device of claim 7, wherein the display driver integrated circuit:

further includes a multiplexer electrically connected with an input terminal of the sense amplifier, and adjusts a magnitude of the output voltage of the sense amplifier by using the multiplexer.

9. The electronic device of claim 1, further comprising:

an external power supply electrically connected with the other end of the at least one sensing line, wherein the display driver integrated circuit applies the first voltage to the other end of the at least one sensing line by using the external power supply.

10. The electronic device of claim 9, wherein the display driver integrated circuit:

further includes a power switch disposed between the external power supply and the at least one sensing line, and turns on the power switch such that the first voltage is applied to the other end of the at least one sensing line from the external power supply in response to the received specified signal.

11. The electronic device of claim 1, further comprising:

second group lines crossing the at least one sensing line and providing a gate voltage to each of the plurality of pixels, wherein the display driver integrated circuit:

further includes a plurality of gate amplifiers electrically connected with the second group lines and providing the gate voltage to each of the plurality of pixels, sequentially applies the first voltage to the other end of the at least one sensing line by sequentially using the plurality of source amplifiers and the plurality of gate amplifiers one by one according to a specified time interval, and sequentially checks whether or not the plurality of source amplifiers and the plurality of gate amplifiers are abnormal based on the difference between the first voltage and the second voltage, according to the specified time interval.

12. The electronic device of claim 11, wherein the plurality of source amplifiers further include first group source switches respectively disposed at output terminals of the plurality of source amplifiers, the plurality of gate amplifiers further include first group gate switches respectively disposed at output terminals of the plurality of gate amplifiers, and the display driver integrated circuit sequentially applies the first voltage to the other end of the at least one sensing line according to the specified time interval by sequentially turning on the first group source switches and the first group gate switches one by one according to the specified time interval.

13. The electronic device of claim 1, further comprising:

an external power supply supplying a specified voltage, wherein the display panel further includes first group transistors electrically connecting the external power supply with each of the first group lines, the display driver integrated circuit further includes a gate amplifier for applying a gate voltage to gate terminals of the first group transistors, and second group switches disposed on the first group lines to selectively connect the first group transistors with at least one sensing line, and the display driver integrated circuit:

applies the gate voltage to the gate terminals of the first group transistors by using the gate amplifier such that the first group transistors are turned on in response to the received specified signal, sequentially turns on the second group switches one by one according to the specified time interval, sequentially applies the first voltage to the other end of the at least one sensing line through any one of the first group transistors and any one of the first group lines by using the external power supply according to the specified time interval, and sequentially checks whether or not the plurality of pixels are cracked based on the difference between the first voltage and the second voltage, according to the specified time interval.

14. The electronic device of claim 1, wherein each of the plurality of pixels includes a plurality of sub-pixels electrically connected with the source amplifiers through the first group lines, and the display driver integrated circuit:

further includes first group sharing switches disposed between at least some of the first group lines on the sensing line such that the sub-pixels included in any one of the plurality of pixels are selectively connected with each other, and turns on the first group switches and the first group sharing switches such that the at least one sensing line is short-circuited from the other end or the at least one sensing line to the sensing circuit.

15. The electronic device of claim 1, wherein each of the plurality of pixels includes a plurality of sub-pixels electrically connected with the source amplifiers through the first group lines, and the display driver integrated circuit:

further includes first group sharing switches disposed between at least some of the first group lines on the sensing line such that at least sub-pixels having the same characteristic among the plurality of sub-pixels are selectively connected with each other, and turns on the first group switches and first group sharing switches such that the at least one sensing line is short-circuited from the other end of the at least one sensing line to the sensing circuit.

* * * * *